US011952741B2

(12) United States Patent
Izumikawa

(10) Patent No.: US 11,952,741 B2
(45) Date of Patent: Apr. 9, 2024

(54) SHOVEL

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 822 days.

(21) Appl. No.: 17/034,494

(22) Filed: Sep. 28, 2020

(65) Prior Publication Data

US 2021/0010228 A1 Jan. 14, 2021

Related U.S. Application Data

(63) Continuation of application No. PCT/JP2019/013628, filed on Mar. 28, 2019.

(30) Foreign Application Priority Data

Mar. 30, 2018 (JP) ..... 2018-069663

(51) Int. Cl.
*E02F 3/43* (2006.01)
*E02F 9/20* (2006.01)
(Continued)

(52) U.S. Cl.
CPC ..... *E02F 3/435* (2013.01); *E02F 9/2004* (2013.01); *E02F 9/2033* (2013.01); *E02F 9/262* (2013.01);
(Continued)

(58) Field of Classification Search
CPC ..... E02F 3/435; E02F 9/2004; E02F 9/2033; E02F 9/262; E02F 3/32; E02F 9/2228; E02F 9/2285; E02F 9/2292; E02F 9/2296; E02F 9/2083; E02F 9/2253; E02F 9/2282; E02F 9/24
USPC ..... 701/50
See application file for complete search history.

(56) References Cited

U.S. PATENT DOCUMENTS 9,493,929 B2 11/2016 Kurihara et al.
10,527,731 B2 1/2020 Kinoshita et al.
(Continued)

FOREIGN PATENT DOCUMENTS

JP 2004-076499 3/2004
JP 2007-023486 2/2007
(Continued)

OTHER PUBLICATIONS

International Search Report for PCT/JP2019/013628 dated Jul. 2, 2019.

*Primary Examiner* — Tyler D Paige
(74) *Attorney, Agent, or Firm* — IPUSA, PLLC

(57) ABSTRACT

A shovel (100) according to an embodiment of the present invention includes a lower travelling body (1), an upper pivot body (3) pivotably mounted to the lower travelling body (1), an object detection device (70) provided to the upper pivot body (3), and a controller (30) that brakes a drive unit of the shovel. The controller (30) is configured to, when the object detection device (70) detects an object, automatically brake the drive unit. The controller is configured to, upon determining that an operator has an intention to continue operation during execution of the braking, deactivate the braking.

7 Claims, 15 Drawing Sheets

(51) Int. Cl.

| | |
|---|---|
| ***E02F 9/26*** | (2006.01) |
| *E02F 3/32* | (2006.01) |
| *E02F 9/22* | (2006.01) |

(52) U.S. Cl.

CPC ..... *E02F 3/32* (2013.01); *E02F 9/2228* (2013.01); *E02F 9/2285* (2013.01); *E02F 9/2292* (2013.01); *E02F 9/2296* (2013.01)

(56) References Cited

U.S. PATENT DOCUMENTS

| | | | | |
|---|---|---|---|---|
| 2002/0152079 | A1 | 10/2002 | Furuta | |
| 2009/0230749 | A1* | 9/2009 | Kostak | B60N 2/777 701/50 |
| 2015/0114731 | A1 | 4/2015 | Tsukamoto | |
| 2015/0314684 | A1* | 11/2015 | Kronberg | B60R 16/0231 340/439 |
| 2017/0320492 | A1* | 11/2017 | Ferrari | B60W 30/0953 |
| 2019/0249399 | A1* | 8/2019 | Shiina | E02F 3/435 |
| 2021/0010228 | A1* | 1/2021 | Izumikawa | E02F 3/435 |

FOREIGN PATENT DOCUMENTS

| | | |
|---|---|---|
| JP | 2009-114750 | 5/2009 |
| JP | 2010-53588 | 3/2010 |
| JP | 2014-101664 | 6/2014 |
| JP | 2017-133355 | 8/2017 |
| WO | 2018/025512 | 2/2018 |

* cited by examiner

SHOVEL

CROSS-REFERENCE TO RELATED APPLICATIONS

The present application is a continuation application of International Application No. PCT/JP2019/013628 filed on Mar. 28, 2019, which claims priority to Japanese Patent Application No. 2018-069663 filed on Mar. 30, 2018. The contents of these applications are incorporated herein by reference in their entirety.

BACKGROUND

Technical Field

The present disclosure relates to shovels as excavators.

Description of the Related Art

Conventionally, a shovel is known in which, if it is determined that a person is present near the shovel, the shovel disables operations caused by an operation lever, and restricts movement of the shovel. This shovel is configured to, when a software button displayed on a display is pushed, cancel the state in which the movement of the shovel is restricted.

SUMMARY

However, an operator that operates the shovel stated above needs to separate his hand from the operation lever and push the software button to deactivate the state in which the movement of the shovel is restricted. As a result, the shovel stated above may cause the operator to feel bothered.

Therefore, it is desirable to provide a shovel that can more easily deactivate the state in which the movement of the shovel is restricted.

A shovel according to an embodiment of the present invention includes a lower travelling body, an upper pivot body pivotably mounted to the lower travelling body, an object detection device provided to the upper pivot body, and a controller that brakes a drive unit of the shovel, wherein the controller is configured to, when the object detection device detects an object, automatically brake the drive unit, and when determining that an operator has an intention to continue operation during execution of the braking, deactivate the braking.

According to the above-stated solution, a shovel that can more easily deactivate the state where the movement of the shovel is restricted is provided.

DETAILED DESCRIPTION

Figure 1:
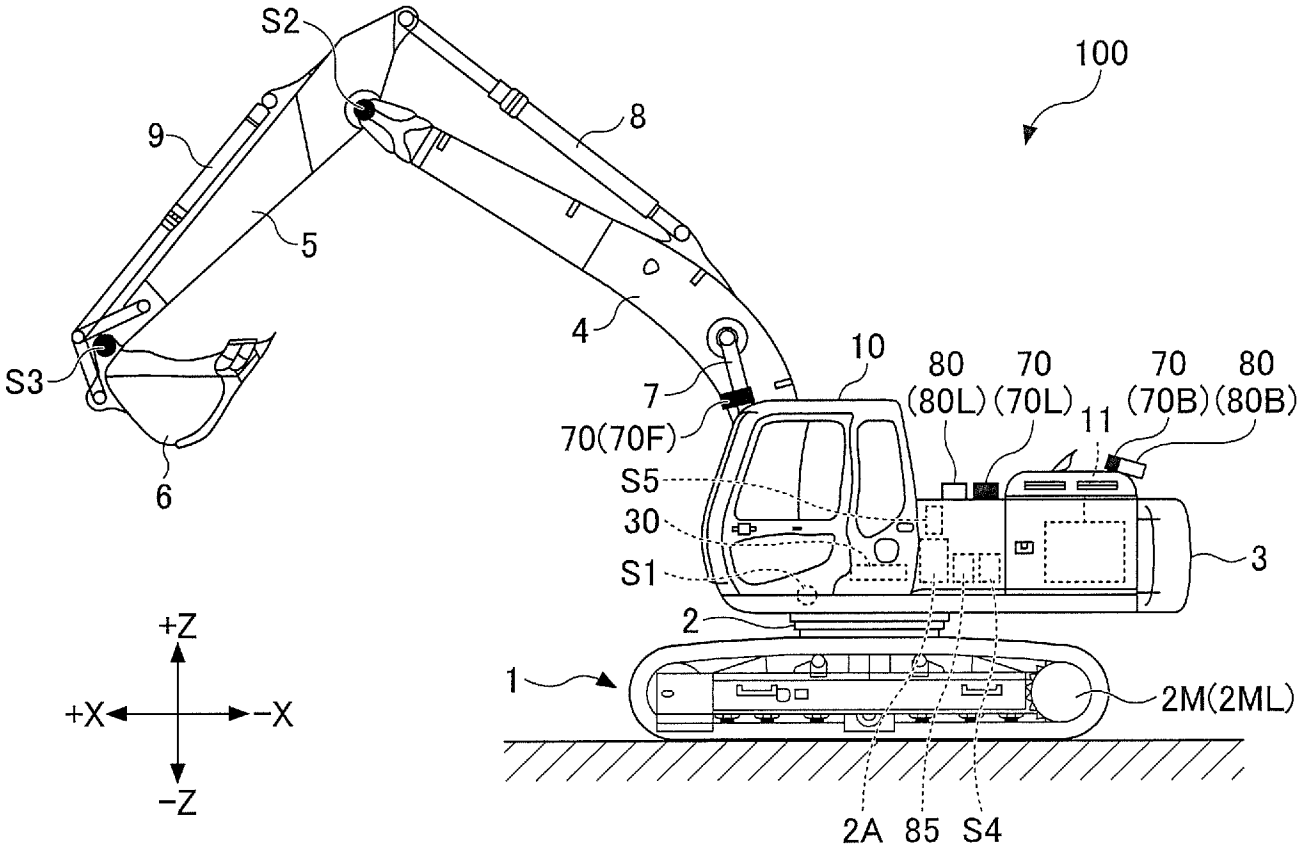
FIG. 1 is a side view of a shovel according to an embodiment of the present invention.
Figure 2:
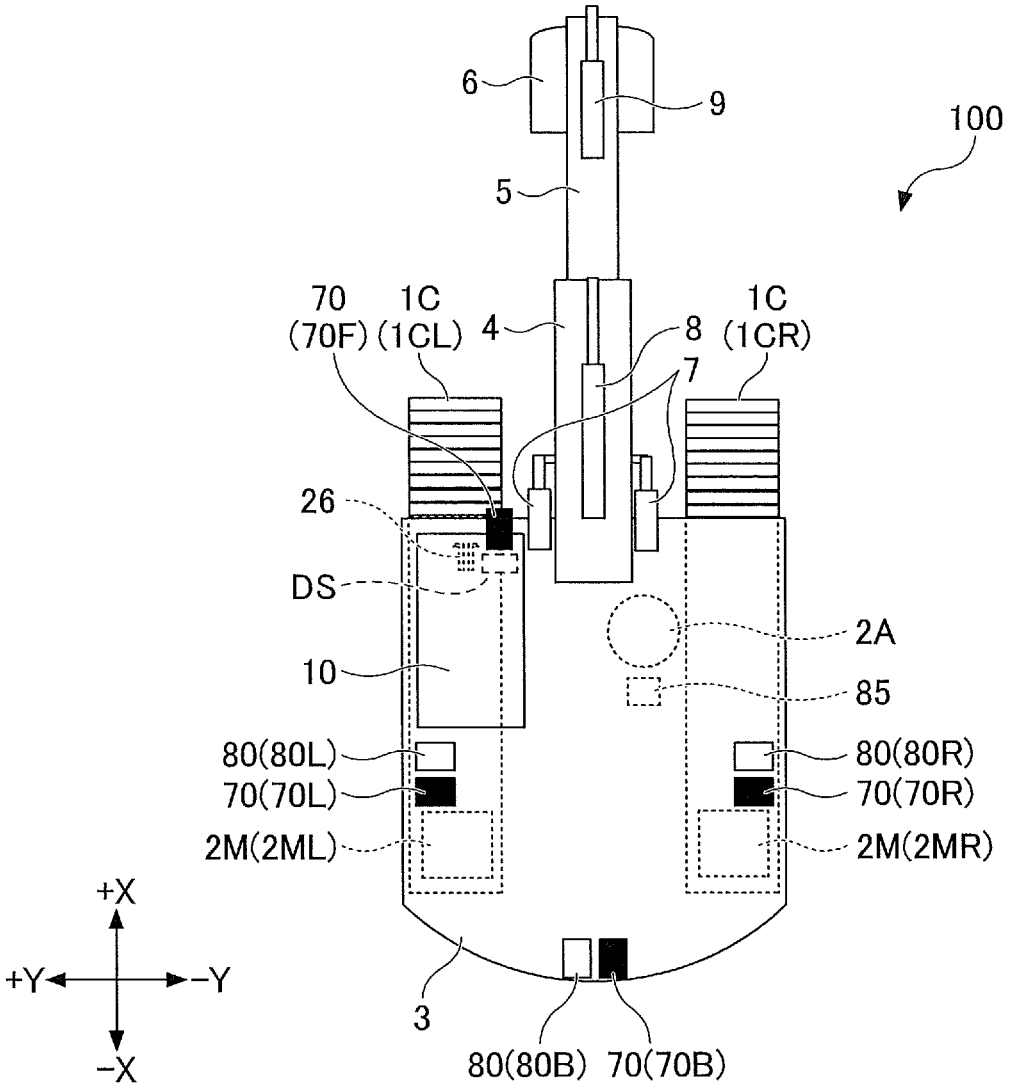
FIG. 2 is a top view of a shovel according to an embodiment of the present invention.

First, a shovel 100 as an excavator according to an embodiment of the present invention is described with reference to FIGS. 1 and 2. FIG. 1 is a side view of the shovel 100, and FIG. 2 is a top view of the shovel 100.

In this embodiment, a lower travelling body 1 of the shovel 100 includes a crawler 1C as a to-be-driven body. The crawler 1C is driven by a travelling hydraulic motor 2M mounted to the lower travelling body 1. Specifically, the crawler 1C includes a left crawler 1CL and a right crawler 1CR. The left crawler 1CL is driven by a left travelling hydraulic motor 2ML, and the right crawler 1CR is driven by a right travelling hydraulic motor 2MR. Because the lower travelling body 1 is driven by the crawler 1C, the lower travelling body 1 serves as a to-be-driven body.

An upper swiveling body 3 is pivotably mounted to the lower travelling body 1 through a pivot mechanism 2. The pivot mechanism 2 as a to-be-driven body is driven by a pivot hydraulic motor 2A mounted to the upper pivot body 3. However, the pivot hydraulic motor 2A may be a pivot electrically driven generator. Since the upper pivot body 3 is driven by the pivot mechanism 2, the upper pivot body serves as a to-be-driven body.

A boom 4 is mounted to the upper pivot body 3. An arm 5 as a to-be-driven body is attached to the tip of the boom 4, and a bucket 6 as a to-be-driven body and an end attachment is attached to the tip of the arm 5. The boom 4, the arm 5, and the bucket 6 compose an excavation attachment AT, which is one exemplary attachment. The boom 4 is driven by a boom cylinder 7, the arm 5 is driven by an arm cylinder 8, and the bucket 6 is driven by a bucket cylinder 9.

A boom angle sensor S1 is mounted to the boom 4, and a bucket angle sensor S3 is mounted to the bucket 6.

The boom angle sensor S1 detects a rotation angle of the boom 4. In this embodiment, the boom angle sensor S1 is an acceleration sensor and can detect a boom angle that is the rotation angle of the boom 4 relative to the upper pivot body 3. The boom angle may become the minimum angle when the boom is most lowered and increase as the boom 4 is raised, for example.

The arm angle sensor S2 detects the rotation angle of the arm 5. In this embodiment, the arm angle sensor S2 is an acceleration sensor and can detect the arm angle that is the rotation angle of the arm 5 relative to the boom 4. The arm angle may become the minimum angle when the arm 5 is the most closed and increases as the arm 5 is opened.

The bucket angle sensor S3 detects the rotation angle of the bucket 6. In this embodiment, the bucket angle sensor S3 is an acceleration sensor and can detect the bucket angle that is the rotation angle of the bucket 6 relative to the arm 5. The bucket angle may become the minimum angle when the bucket is most closed and increase as the bucket 6 is opened.

The boom angle sensor S1, the arm angle sensor S2, and the bucket angle sensor S3 may each be a potentiometer utilizing a variable resistor, a stroke sensor for detecting a stroke amount of the corresponding hydraulic cylinder, a rotary encoder for detecting a rotation angle around a coupling pin, a gyro sensor, a combination of an acceleration sensor and a gyro sensor, and the like.

A cabin 10 is provided to the upper pivot body 3 as an operator's cab, and a power source such as an engine 11 is mounted therein. Also, a controller 30, an object detection device 70, a capturing device 80, an orientation detection device 85, a body tilt sensor S4, and a pivot angular velocity sensor S5 and the like are mounted to the upper pivot body 3. An operation device 26 or the like is mounted in the cabin 10. For convenience, it is assumed in the specification that the side where the boom 4 is mounted in the upper pivot body 3 is the front side and the side where a counterweight is mounted is the rear side.

The controller 30 is a control device for controlling the shovel 100. In this embodiment, the controller 30 is composed of a computer including a CPU, a RAM, an NVRAM, a ROM and the like. Then, the controller 30 reads programs corresponding to respective functional elements from the ROM, loads them in the RAM and causes the CPU to execute the corresponding operations.

The object detection device 70 is configured to detect an object existing around the shovel 100. Also, the object detection device 70 may be configured to calculate the distance from the object detection device 70 or the shovel 100 to a recognized object. The object may include humans, animals, vehicles, construction machines, structures, holes, and the like, for example. The object detection device 70 may include an ultrasonic sensor, a millimeter wave radar, a stereo camera, a LIDAR, a distance image sensor, an infrared sensor, and the like, for example. In this embodiment, the object detection device 70 includes a front sensor 70F mounted to the top end of the front surface of the cabin 10, a rear sensor 70B mounted to the rear end of the top surface of the upper pivot body 3, a left sensor 70L mounted to the left end of the top surface of the upper pivot body 3, and a right sensor 70R mounted to the right end of the top surface of the upper pivot body 3.

The object detection device 70 may be configured to detect a predetermined object in a predetermined area set around the shovel 100. For example, the object detection device 70 may be configured to distinguish between humans and objects other that the humans.

The capturing device 80 is configured to capture the periphery of the shovel 100. In this embodiment, the capturing device 80 includes a rear camera 80B mounted to the rear end of the top surface of the upper pivot body 3, a left camera 80L mounted to the left end of the top surface of the upper pivot body 3, and a right camera 80R mounted to the right end of the top surface of the upper pivot body 3. A front camera may be included.

The rear camera 80B is positioned adjacent to the rear sensor 70B, the left camera 80L is positioned adjacent to the left sensor 70L, and the right camera 80R is positioned adjacent to the right sensor 70R. The front camera may be positioned adjacent to the front sensor 70F.

An image captured by the capturing device 80 is displayed on a display DS located in the cabin 10. The capturing device 80 may be configured to display a viewpoint conversion image, such as a bird's-eye image, on the display device DS. For example, the bird's-eye image is generated by combining respective images fed from the rear camera 80B, the left camera 80L, and the right camera 80R.

The capturing device 80 may function as the object detection device. In this case, the object detection device 70 may be omitted.

According to this arrangement, the shovel 100 can display an image of an object detected by the object detection device 70 on the display device DS. Therefore, if the movement of a to-be-driven object is restricted or prohibited, the operator of the shovel 100 can immediately check what object is the cause by viewing the image displayed on the display device DS.

The orientation detection device 85 is configured to detect information (referred to as "information regarding orientation" hereinafter) regarding the relative relationship between the orientation of the upper pivot body 3 and the orientation of the lower travelling body 1. The orientation detection device 71 may be composed of, for example, a combination of a geomagnetic sensor mounted to the lower travelling body 1 and a geomagnetic sensor mounted to the upper pivot body 3. Alternatively, the orientation detection device 85 may be composed of, for example, a combination of a GNSS receiver mounted to the lower travelling body 1 and a GNSS receiver mounted to the upper pivot body 3. In the arrangement in which the upper pivot body 3 is pivotably driven by a pivot electric generator, the orientation detection device 85 may be composed of a resolver. The orientation detection device 85 may be mounted, for example, to a center joint disposed in connection with the pivot mechanism 2 for implementing the relative rotation between the lower travelling body 1 and the upper pivot body 3.

The body tilt sensor S4 detects the tilt of the shovel 100 relative to a predetermined plane. In this embodiment, the body tilt sensor S4 is an acceleration sensor to detect a tilt angle about the front-rear axis of the upper pivot body 3 with respect to the horizontal plane and a tilt angle about the right-left axis. The body tilt sensor S4 may be configured as a combination of an acceleration sensor and a gyro sensor. The front-rear axis and the left-right axis of the upper pivot body 3 pass through a shovel center point, which is one point on the pivot axis of the shovel 100 perpendicular to each other, for example.

The pivot angular velocity sensor S5 detects the pivot angular velocity of the upper pivot body 3. In this embodiment, it is a gyro sensor. It may be a resolver, a rotary encoder, or the like. The pivot angular velocity sensor S5 may detect the pivot velocity. The pivot velocity may be calculated from the pivot angular velocity.

Hereinafter, any combination of the boom angle sensor S1, the arm angle sensor S2, the bucket angle sensor S3, the body tilt sensor S4, and the pivot angular velocity sensor S5 is collectively referred to as a posture sensor.

Figure 3:
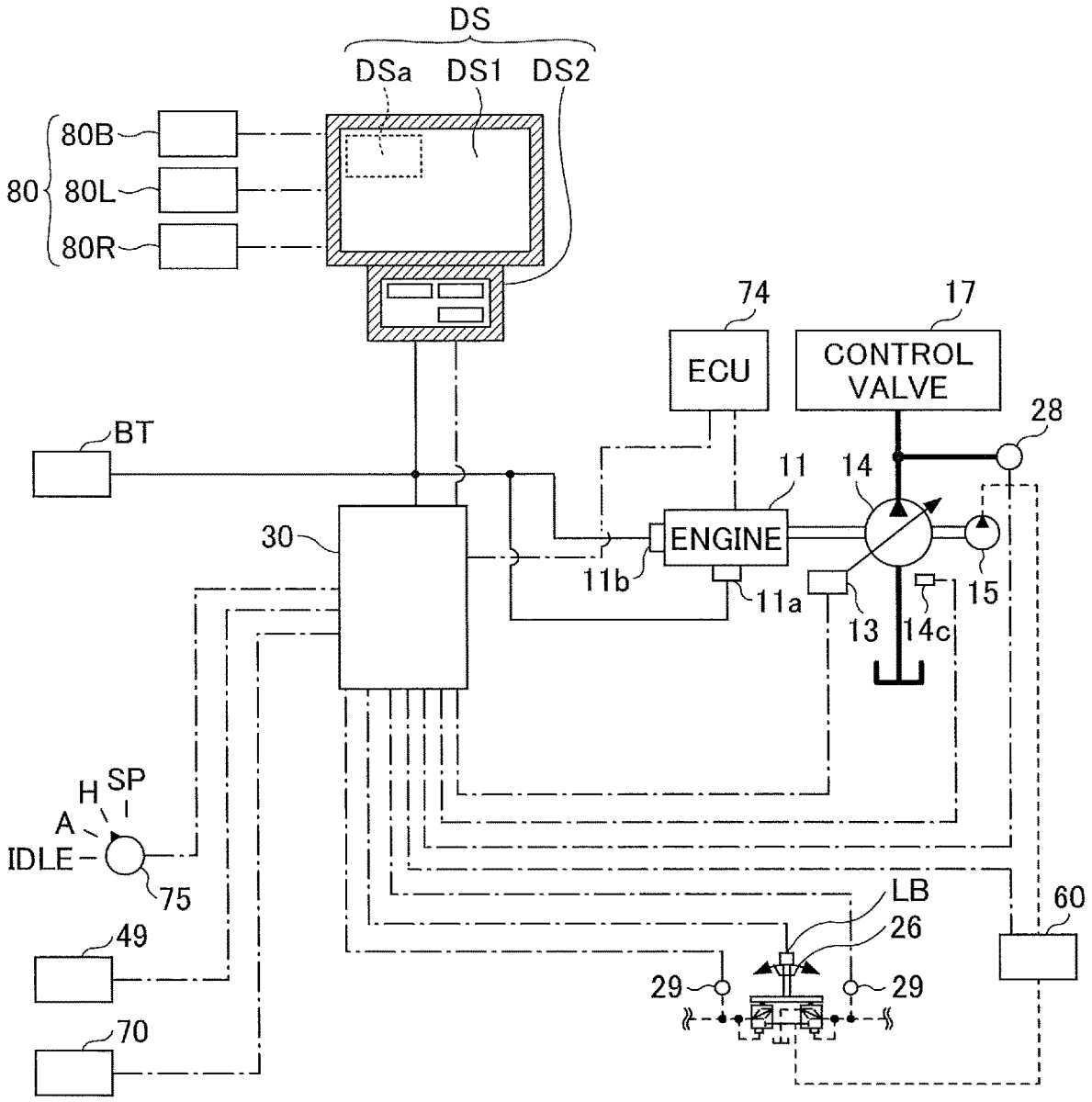
FIG. 3 is a diagram for illustrating an exemplary arrangement of a fundamental system mounted to a shovel.

Next, a fundamental system mounted to the shovel 100 is described with reference to FIG. 3. FIG. 3 illustrates an exemplary arrangement of the fundamental system mounted to the shovel 100. In FIG. 3, a mechanical power transmission line is shown as a double line, a hydraulic oil line is shown as a thick solid line, a pilot line is shown as a dashed line, a power line is shown as a fine solid line, and an electric control line is shown as a single dashed line.

The fundamental system primarily includes an engine 11, a main pump 14, a pilot pump 15, a control valve 17, an operation device 26, an operation pressure sensor 29, a controller 30, an alarm device 49, a control valve 60, an object detection device 70, an engine control unit (ECU 74), an engine rotation rate adjustment dial 75, an capturing device 80 and the like.

The engine 11 is a diesel engine employing isochronous control that maintains a constant engine rotation rate regardless of the increase or decrease of the load. The fuel injection amount, the fuel injection timing, the boost pressure, and the like in the engine 11 are controlled by the ECU 74. The engine 11 is coupled to the main pump 14 and the pilot pump 15 serving as hydraulic pumps. The main pump 14 is coupled to the control valve 17 via a hydraulic oil line.

The control valve 17 is a hydraulic controller that controls the hydraulic system of the shovel 100. The control valve 17 is coupled to hydraulic actuators such as a left travelling hydraulic motor 2ML, a right travelling hydraulic motor 2MR, a boom cylinder 7, an arm cylinder 8, a bucket cylinder 9, and a pivot hydraulic motor 2A. Specifically, the control valve 17 includes a plurality of spool valves corresponding to the respective hydraulic actuators. Each spool valve is configured to be displaceable depending on the pilot pressure so that the opening area of a PC port and the opening area of a CT port can be increased or decreased. The PC port is a port that connects the main pump 14 to the hydraulic actuators. The CT port is a port that connects the hydraulic actuators to a hydraulic oil tank.

The operation device 26 is a device used by an operator to operate actuators. The actuator includes at least one of a hydraulic actuator and an electric actuator. In this embodiment, the operation device 26 is a hydraulic operation device that supplies the hydraulic oil discharged by the pilot pump 15 to a pilot port of the corresponding spool valve in the control valve 17 via a pilot line. The pressure (pilot pressure) of the hydraulic oil supplied to each of the pilot ports is the pressure corresponding to the operation direction and the operation amount of the operation device 26 corresponding to each of the hydraulic actuators. The operation device 26 may include, for example, a left operation lever, a right operation lever and a travelling operation device. The travelling operation device may include, for example, a travelling lever and a travelling pedal. The operation device 26 may be an electric operation device.

The discharge pressure sensor 28 detects the discharge pressure of the main pump 14. In this embodiment, the discharge pressure sensor 28 outputs the detected value to the controller 30.

The operation pressure sensor 29 detects operational contents of the operation device 26 by an operator. In this embodiment, the operation pressure sensor 29 detects the operation direction and the operation amount of the operation device 26 corresponding to each of the actuators in the form of pressure (operation pressure) and outputs the detected value to the controller 30. The operational contents of the operation device 26 may be detected using other sensors other than the operation pressure sensor.

An alarm device 49 is configured to alert a person engaged in works of the shovel 100. The alarm device 49 may include, for example, a combination of an indoor alarm device and an outdoor alarm device. The indoor alarm device is configured to alert an operator of the shovel 100 in the cabin 10. The indoor alarm device may include, for example, at least one of a sound output device AD, a vibration generation device, and a light emitting device disposed in the cabin 10. The indoor alarm device may be a display device DS. The outdoor alarm device is configured to alert a worker working around the shovel 100. The outdoor alarm device may include, for example, at least one of a sound output device AD and a light emitter provided outside of the cabin 10. The sound output device AD as the outdoor alarm device may be, for example, a travelling alarm device mounted to the bottom surface of the upper pivot body 3. The outdoor alarm device may be a light emitting device provided on the upper pivot body 3. However, the outdoor alarm device may be omitted. The alarm device 49 may, for example, alert a person engaged in the operation of the shovel 100 when the object detection device 70 detects an object.

The control valve 60 is configured to switch between an enabled state and a disabled state of the operation device 26. The enabled state of the operation device 26 is a state where an operator can use the operation device 26 to operate the hydraulic actuator. The disabled state of the operation device 26 is a state where the operator cannot use the operation device 26 to operate the hydraulic actuator. In this embodiment, the control valve 60 is a gate lock valve configured to operate in response to a command from the controller 30. Specifically, the control valve 60 is arranged in a pilot line for coupling the pilot pump 15 to the operation device 26 so that the pilot line can be switched on/off in response to a command from the controller 30. The operation device 26 is enabled, for example, when the gate lock lever (not shown) is pulled up to open the gate lock valve, and disabled when the gate lock lever is depressed to close the gate lock valve.

The ECU 74 feeds data regarding the state of the engine 11, such as the cooling water temperature, to the controller 30. The regulator 13 of the main pump 14 feeds data regarding a swashplate tilt angle to the controller 30. The discharge pressure sensor 28 feeds data regarding the discharge pressure of the main pump 14 to the controller 30. An oil temperature sensor 14*c* provided in a conduit between the hydraulic oil tank and the main pump 14 feeds data regarding the temperature of the hydraulic oil flowing through the conduit to the controller 30. The operation pressure sensor 29 feeds data regarding the pilot pressure generated when the operation device 26 is operated to the controller 30. The controller 30 stores the data in a temporary storage unit (memory) and feeds the data to the display device DS when necessary.

The engine rotation rate adjustment dial 75 is a dial for adjusting the rotation rate of the engine 11. The engine rotation rate adjustment dial 75 feeds data regarding the set state of the engine rotation rate to the controller 30. The engine rotation rate adjustment dial 75 is configured to switch the engine rotation rate in four stages: SP mode, H mode, A mode and idling mode. The SP mode is the rotation rate mode selected if the workload is desired to be prioritized, and uses the highest engine rotation rate. The H mode is the rotation rate mode selected if both the workload and fuel economy are desired to be compatible with each other, and uses the second highest engine rotation rate. The A mode is the rotation rate mode selected if the shovel 100 is desired to be operated with low noise while prioritizing the fuel economy, and uses the third highest engine rotation rate. The idling mode is the rotation rate mode selected if the engine 11 is desired to be idle, and uses the lowest engine rotation rate. The engine 11 is controlled to be constant at the engine rotation rate corresponding to the rotation rate mode set by the engine rotation rate adjustment dial 75.

The display device DS includes a control unit DSa, an image display unit DS1, and a switch panel DS2 as an input unit. The control unit DSa is configured to control an image displayed on the image display unit DS1. In this embodiment, the control unit DSa is configured as a computer including a CPU, a RAM, an NVRAM, and a ROM. In this case, the control unit DSa reads programs corresponding to functional elements from the ROM, loads them to the RAM, and causes the CPU to execute the corresponding operation. However, each functional element may be composed of hardware or a combination of software and hardware. Also, the image displayed on the image display unit DS1 may be controlled by the controller 30 or the capturing device 80.

The switch panel DS2 is a panel including a hardware switch. The switch panel DS2 may be a touch panel. The display device DS operates in response to power supplied from a battery BT. The battery BT is charged with electricity generated by an alternator 11*a*, for example. The power of the battery BT may be supplied to the controller 30 or the like. A starter 11*b* of the engine 11 is powered by power from the battery BT to activate the engine 11, for example.

A lever button LB is a button provided to the operation device 26. In this embodiment, the lever button LB is a button provided at the tip of the operation lever as the operation device 26. The operator of the shovel 100 can operate the lever button LB while operating the operation lever. For example, the operator can push the lever button LB with his thumb while holding the operation lever with his hand.

Figure 4:
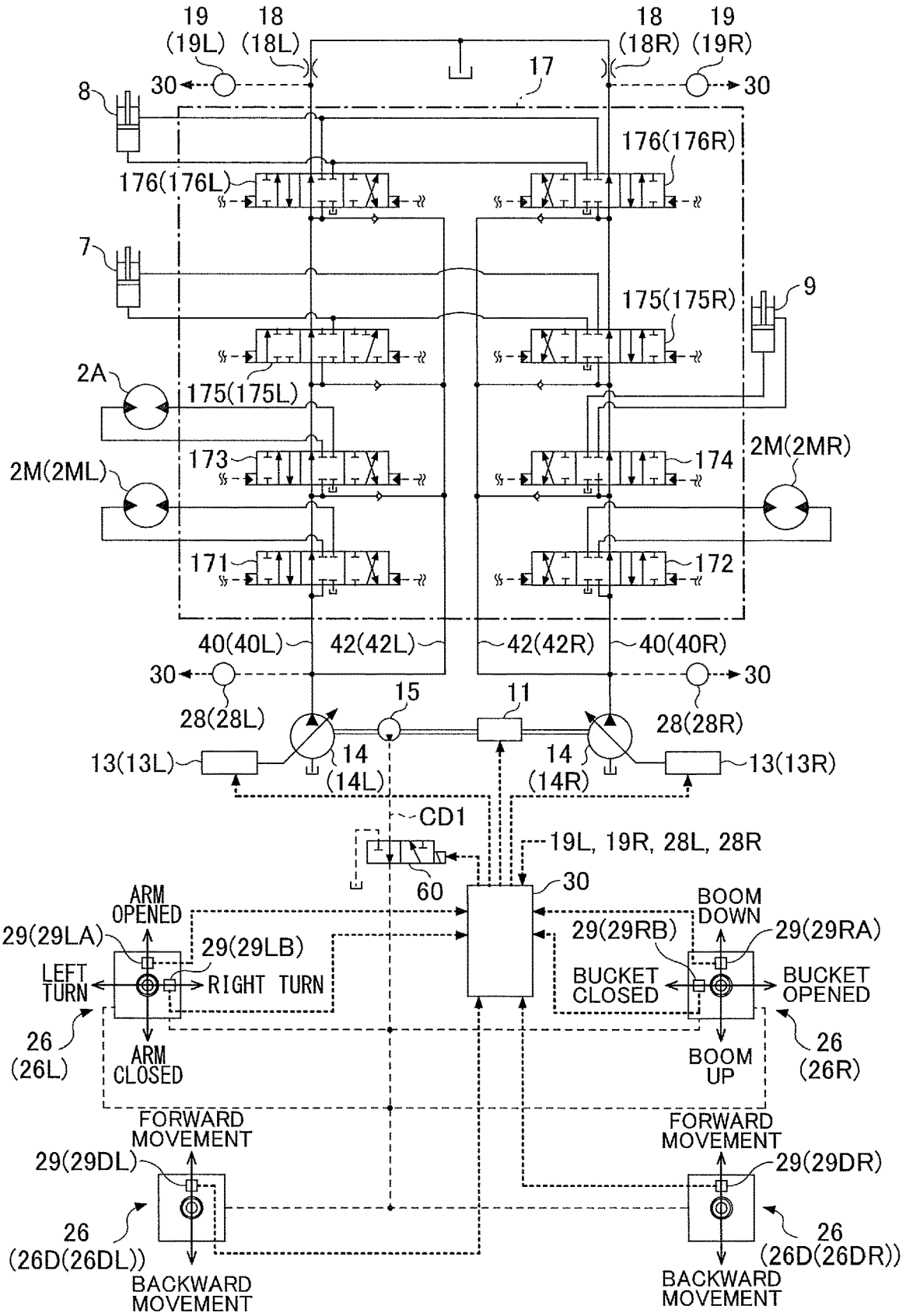
FIG. 4 is a diagram for illustrating an exemplary arrangement of a hydraulic system mounted to a shovel.

Next, an exemplary arrangement of a hydraulic system mounted to the shovel 100 is described with reference to FIG. 4. FIG. 4 is a diagram for illustrating an exemplary arrangement of the hydraulic system mounted to the shovel 100. FIG. 4 shows a mechanical power transmission system, a hydraulic oil line, a pilot line and an electric control system with a double line, a solid line, a dashed line and a dotted line, respectively.

The hydraulic system of the shovel 100 mainly includes an engine 11, a regulator 13, a main pump 14, a pilot pump 15, a control valve 17, an operation device 26, a discharge pressure sensor 28, an operation pressure sensor 29, a controller 30, a control valve 60 and the like.

In FIG. 4, the hydraulic system is configured to circulate the hydraulic oil from the main pump 14 driven by the engine 11 to the hydraulic oil tank via a center bypass line 40 or a parallel line 42.

The engine 11 is a driving source of the shovel 100. In this embodiment, the engine 11 may be, for example, a diesel engine for operating to retain a predetermined number of rotations. The output shaft of the engine 11 is coupled to the input shaft of the main pump 14 and the pilot pump 15.

The main pump 14 is configured to supply the hydraulic oil to the control valve 17 via a hydraulic oil line. In this embodiment, the main pump 14 is a swashplate variable capacity type of hydraulic pump.

The regulator 13 is configured to control the discharge amount of the main pump 14. In this embodiment, the regulator 13 controls the discharge amount of the main pump 14 by adjusting the swashplate tilt angle of the main pump 14 in response to a control command from the controller 30.

The pilot pump 15 is configured to supply the hydraulic oil to a hydraulic control device including the operation device 26 through a pilot line. In this embodiment, the pilot pump 15 is a fixed capacity type of hydraulic pump. However, the pilot pump 15 may be omitted. In this case, the function performed by the pilot pump 15 may be implemented by the main pump 14. Namely, the main pump 14 may include a function of supplying the hydraulic oil to the operation device 26 or the like after reduction in the pressure of the hydraulic oil with a throttle or the like separately from a function of supplying the hydraulic oil to the control valve 17.

The control valve 17 is a hydraulic controller for controlling the hydraulic system in the shovel 100. In this embodiment, the control valve 17 includes control valves 171 to 176. The control valve 175 includes control valve 175L and control valve 175R, and the control valve 176 includes control valves 176L and 1756. The control valve 17 is configured to selectively supply the hydraulic oil discharged by the main pump 14 to one or more hydraulic actuators through the control valves 171 to 176. The control valves 171 to 176 may control, for example, the flow amount of the hydraulic oil flowing from the main pump 14 to the hydraulic actuator and the flow amount of the hydraulic oil flowing from the hydraulic actuator to the hydraulic oil tank. The hydraulic actuator include the boom cylinder 7, the arm cylinder 8, the bucket cylinder 9, the left travelling hydraulic motor 2ML, the right travelling hydraulic motor 2MR, and the pivot hydraulic motor 2A.

The main pump 14 includes a left main pump 14L and a right main pump 14R. Then, the left main pump 14L circulates the hydraulic oil to the hydraulic oil tank through the left center bypass line 40L or the left parallel line 42L, and the right main pump 14R circulates the hydraulic oil to the hydraulic oil tank through the right center bypass line 40R or the right parallel line 42R.

The left center bypass line 40L is a hydraulic oil line for passing through the control valves 171, 173, 175L and 176L disposed in the control valve 17. The right center bypass line 40R is a hydraulic oil line for passing through the control valves 172, 174, 175R and 176R disposed in the control valve 17.

The control valve 171 is a spool valve for feeding the hydraulic oil discharged by the left main pump 14L to the left travelling hydraulic motor 2ML and switching the flow of the hydraulic oil to discharge the hydraulic oil discharged by the left travelling hydraulic motor 2ML to the hydraulic oil tank.

The control valve 172 is a spool valve for feeding the hydraulic oil discharged by the right main pump 14R to the right travelling hydraulic motor 2MR and switching the flow of the hydraulic oil to discharge the hydraulic oil discharged by the right travelling hydraulic motor 2MR to the hydraulic oil tank.

The control valve 173 is a spool valve for feeding the hydraulic oil discharged by the left main pump 14L to the pivot hydraulic motor 2A and switching the flow of the hydraulic oil to discharge the hydraulic oil discharged by the pivot hydraulic motor 2A to the hydraulic oil tank.

The control valve 174 is a spool valve for feeding the hydraulic oil discharged by the right main pump 14R to the bucket cylinder 9 and switching the flow of the hydraulic oil to discharge the hydraulic oil in the bucket cylinder 9 to the hydraulic oil tank.

The control valve 175L is a spool valve for switching the flow of the hydraulic oil to supply the hydraulic oil discharged by the left main pump 14L to the boom cylinder 7. The control valve 175R is a spool valve for feeding the hydraulic oil discharged by the right main pump 14R to the boom cylinder 7 and switching the flow of the hydraulic oil to discharge the hydraulic oil in the boom cylinder 7 to the hydraulic oil tank.

The control valve 176L is a spool valve for feeding the hydraulic oil discharged by the left main pump 14L to the arm cylinder 8 and switching the flow of the hydraulic oil to discharge the hydraulic oil in the arm cylinder 8 to the hydraulic oil tank.

The control valve 176R is a spool valve for feeding the hydraulic oil discharged by the right main pump 14R to the arm cylinder 8 and switching the flow of the hydraulic oil to discharge the hydraulic oil in the arm cylinder 8 to the hydraulic oil tank.

The left parallel line 42L is a hydraulic oil line parallel to the left center bypass line 40L. If the flow of the hydraulic oil passing through the left center bypass line 40L is limited or interrupted by any of the control valves 171, 173 and 175L, the left parallel line 42L can supply the hydraulic oil to a downstream control valve. The right parallel line 42R is a hydraulic oil line parallel to the right center bypass line 40R. If the flow of the hydraulic oil passing through the right center bypass line 40R is limited or interrupted by any of the control valves 172, 174 and 175R, the right parallel line 42R can supply the hydraulic oil to a downstream control valve.

The regulator 13 includes a left regulator 13L and a right regulator 13R. The left regulator 13L controls the discharge amount of the left main pump 14L by adjusting the swashplate tilt angle of the left main pump 14L depending on the discharge pressure of the left main pump 14L. Specifically, the left regulator 13L adjusts the swashplate tilt angle of the left main pump 14L in accordance with increasing the discharge pressure of the left main pump 14L to reduce the discharge amount, for example. The same applies to the right regulator 13R. This is to avoid the absorbed horsepower of the main pump 14, which is expressed as the product of the discharge pressure and the discharge amount, exceeding the output horsepower of the engine 11.

The operation device 26 includes a left operation lever 26L, a right operation lever 26R and a travelling lever 26D. The travelling lever 26D includes a left travelling lever 26DL and a right travelling lever 26DR.

The left operation lever 26L is used for the rotation operation and the operation of the arm 5. The left operation lever 26L, when it is operated in a forward-backward direction, utilizes the hydraulic oil discharged by the pilot pump 15 to introduce the control pressure corresponding to the lever operation amount into the pilot port of the control valve 176. Also, when it is operated in the right-left direction, the left operation lever 26L utilizes the hydraulic oil discharged by the pilot pump 15 to introduce the control pressure corresponding to the lever operation amount into the pilot port of the control valve 173.

Specifically, when it is operated in the arm closing direction, the left operation lever 26L introduces the hydraulic oil to the right pilot port of the control valve 176L and introduces the hydraulic oil to the left pilot port of the control valve 176R. Also, the left operation lever 26L, when it is operated in the arm opening direction, introduces the hydraulic oil to the left pilot port of the control valve 176L and introduces the hydraulic oil to the right pilot port of the control valve 176R. Also, when it is operated in the left pivot direction, the left operation lever 26L introduces the hydraulic oil to the left pilot port of the control valve 173 and when it is operated in the right pivot direction, introduces the hydraulic oil to the right pilot port of the control valve 173.

The right operation lever 26R is used to operate the boom 4 and the bucket 6. The right operation lever 26R, when it is operated in the forward-backward direction, utilizes the hydraulic oil discharged by the pilot pump 15 to introduce the control pressure corresponding to the lever operation amount into the pilot port of the control valve 175. Also, when it is operated in the right-left direction, the right operation lever 26R utilizes the hydraulic oil discharged by the pilot pump 15 to introduce the control pressure corresponding to the lever operation amount into the pilot port of the control valve 174.

Specifically, the right operation lever 26R, when it is operated in the boom down direction, introduces the hydraulic oil to the left pilot port of the control valve 175R. Also, the right operation lever 26R, when it is operated in the boom up direction, introduces the hydraulic oil to the right pilot port of the control valve 175L and introduces the hydraulic oil to the left pilot port of the control valve 175R. Also, the right operation lever 26R, when it is operated in the bucket closing direction, introduces the hydraulic oil to the right pilot port of the control valve 174 and when it is operated in the bucket opening direction, introduces the hydraulic oil to the left pilot port of the control valve 174.

The travelling lever 26D is used to operate the crawler 10. Specifically, the left travelling lever 26DL is used to operate the left crawler 1CL. It may be configured to interlock with the left travelling pedal. The left travelling lever 26DL, when it is operated in the forward-backward direction, utilizes the hydraulic oil discharged by the pilot pump 15 to introduce the control pressure corresponding to the lever operation amount into the pilot port of the control valve 171. The right travelling lever 26DR is used to operate the right crawler 1CR. It may be configured to interlock with the right travelling pedal. The right travelling lever 26DR, when it is operated in the forward-backward direction, utilizes the hydraulic oil discharged by the pilot pump 15 to introduce the control pressure corresponding to the lever operation amount into the pilot port of the control valve 172.

The discharge pressure sensor 28 includes a discharge pressure sensor 28L and a discharge pressure sensor 28R. The discharge pressure sensor 28L detects the discharge pressure of the left main pump 14L and outputs a detected value to the controller 30. The same applies to the discharge pressure sensor 28R.

The operation pressure sensor 29 includes operation pressure sensors 29LA, 29LB, 29RA, 29RB, 29DL and 29DR. The operation pressure sensor 29LA detects operational contents of the left operation lever 26L in the forward-backward direction by the operator in the form of pressure and outputs a detected value to the controller 30. The operational contents may be, for example, the lever operation direction, the lever operation amount (lever operation angle) or the like.

Similarly, the operation pressure sensor 29LB detects operational contents of the left operation lever 26L in the left-right direction by the operator in the form of pressure and outputs a detected value to the controller 30. The operation pressure sensor 29RA detects operational contents of the right operation lever 26R in the forward-backward direction by the operator in the form of pressure and outputs a detected value to the controller 30. The operation pressure sensor 29RB detects operational contents of the right operation lever 26R in the left-right direction by the operator in the form of pressure and outputs a detected value to the controller 30. The operation pressure sensor 29DL detects operational contents of the left travelling lever 26DL in the forward-backward direction by the operator in the form of pressure and outputs a detected value to the controller 30. The operation pressure sensor 29DR detects operational contents of the right travelling lever 26DR in the forward-backward direction by the operator in the form of pressure and outputs a detected value to the controller 30.

The controller 30 receives an output of the operation pressure sensor 29 and outputs a control command to the regulator 13 as needed to change the discharge amount of the main pump 14.

Here, negative control using a throttle 18 and a control pressure sensor 19 is described. The throttle 18 includes a left throttle 18L and a right throttle 18R, and the control pressure sensor 19 includes a left control sensor 19L and a right control sensor 19R.

In the left center bypass line 40L, the left throttle 18L is disposed between the control valve 176L, which is in the most downstream, and the hydraulic oil tank. Therefore, the flow of the hydraulic oil discharged by the left main pump 14L is limited by the left throttle 18L. Then, the left throttle 18L generates a control pressure for controlling the left regulator 13L. The left control pressure sensor 19L is a sensor for detecting the control pressure and outputting a detected value to the controller 30. The controller 30 controls the discharge amount of the left main pump 14L by adjusting the swashplate tilt angle of the left main pump 14L depending on the control pressure. The controller 30 decreases the discharge amount of the left main pump 14L as the control pressure is higher, and increases the discharge amount of the left main pump 14L as the control pressure is lower. The discharge amount of the right main pump 14R is similarly controlled.

Specifically, if none of the hydraulic actuators in the shovel 100 is in the non-operated standby state as shown in FIG. 4, the hydraulic oil discharged by the left main pump 14L passes through the left center bypass line 40L toward the left throttle 18L. Then, the flow of the hydraulic oil discharged by the left main pump 14L increases the control pressure generated in the upstream of the left throttle 18L. As a result, the controller 30 reduces the discharge amount of the left main pump 14L to an allowable minimum discharge amount and suppresses the pressure loss (pumping loss) at passage of the discharged hydraulic oil through the left center bypass line 40L. On the other hand, if any of the hydraulic actuators is operated, the hydraulic oil discharged by the left main pump 14L flows into a to-be-operated hydraulic actuator through a control valve corresponding to the to-be-operated hydraulic actuator. Then, the flow of the hydraulic oil discharged by the left main pump 14L decreases or disappears the amount reaching the left throttle 18L, thereby lowering the control pressure generated in the upstream of the left throttle 18L. As a result, the controller 30 increases the discharge amount of the left main pump 14L to circulate a sufficient amount of the hydraulic oil to the to-be-operated hydraulic actuator to ensure driving of the to-be-operated hydraulic actuator. Note that the controller 30 controls the discharge amount of the right main pump 14R in the same manner.

According to the above-stated arrangement, the hydraulic system of FIG. 4 can reduce wasted energy consumption at the main pump 14 in the standby state. The wasteful energy consumption includes a pumping loss caused by the hydraulic oil discharged by the main pump 14 in the center bypass line 40. Also, the hydraulic system of FIG. 4, when the hydraulic actuator is operated, ensures that a necessary and sufficient amount of the hydraulic oil can be supplied from the main pump 14 to the to-be-operated hydraulic actuator.

The control valve 60 is configured to switch between an enabled state and a disabled state of the operation device 26. In this embodiment, the control valve 60 is a spool type solenoid valve configured to operate in response to a current command from the controller 30. The enabled state of the operation device 26 is a state where an operator can operate the operation device 26 to move an associated to-be-driven object, and the disabled state of the operation device 26 is a state where the operator cannot operate the operation device 26 to move the associated to-be-driven object.

In this embodiment, the control valve 60 is a solenoid valve capable of switching between a connection state and a disconnection state of a pilot line CD1 which couples the pilot pump 15 to the operation device 26. Specifically, the control valve 60 is configured to switch between the connection state and the disconnection state of the pilot line CD1 in response to a command from the controller 30. More specifically, the control valve 60 causes the pilot line CD1 to be in the connection state when it is in a first valve position and to be in the disconnection state when it is in a second valve position. FIG. 4 shows that the control valve 60 is in the first valve position and that the pilot line CD1 is in the connection state.

The control valve 60 may be configured to interlock with a gate lock lever (not shown). Specifically, the pilot line CD1 may be changed into the disconnection state when the gate lock lever is depressed, and the pilot line CD1 may be changed into the connection state when the gate lock lever is pulled up. Also, the control valve 60 may be configured to switch between the enabled state and the disabled state for each of the plurality of operating devices 26 separately.

Figure 5A:
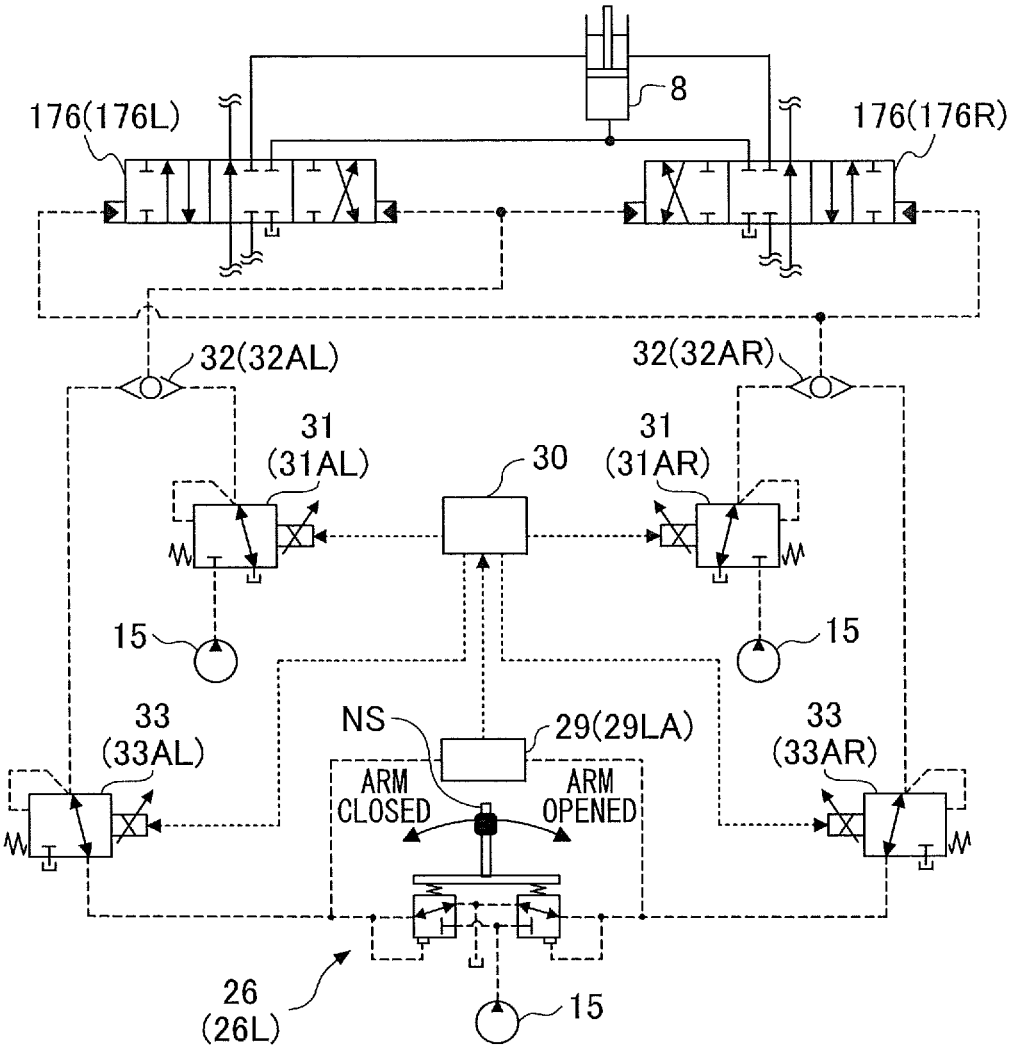
FIG. 5A is a view of a portion of a hydraulic system related to operations of an arm cylinder.
Figure 5B:
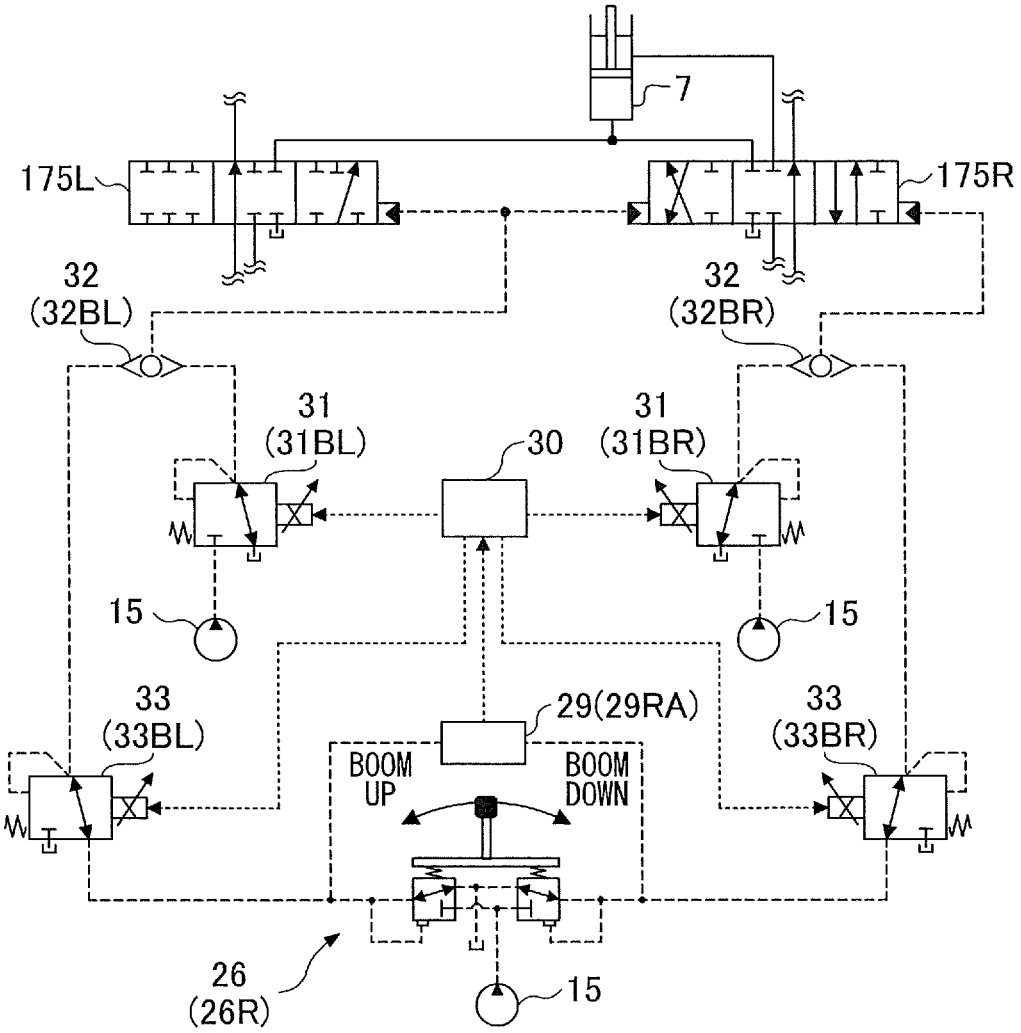
FIG. 5B is a view of a portion of a hydraulic system related to operations of a boom cylinder.
Figure 5C:
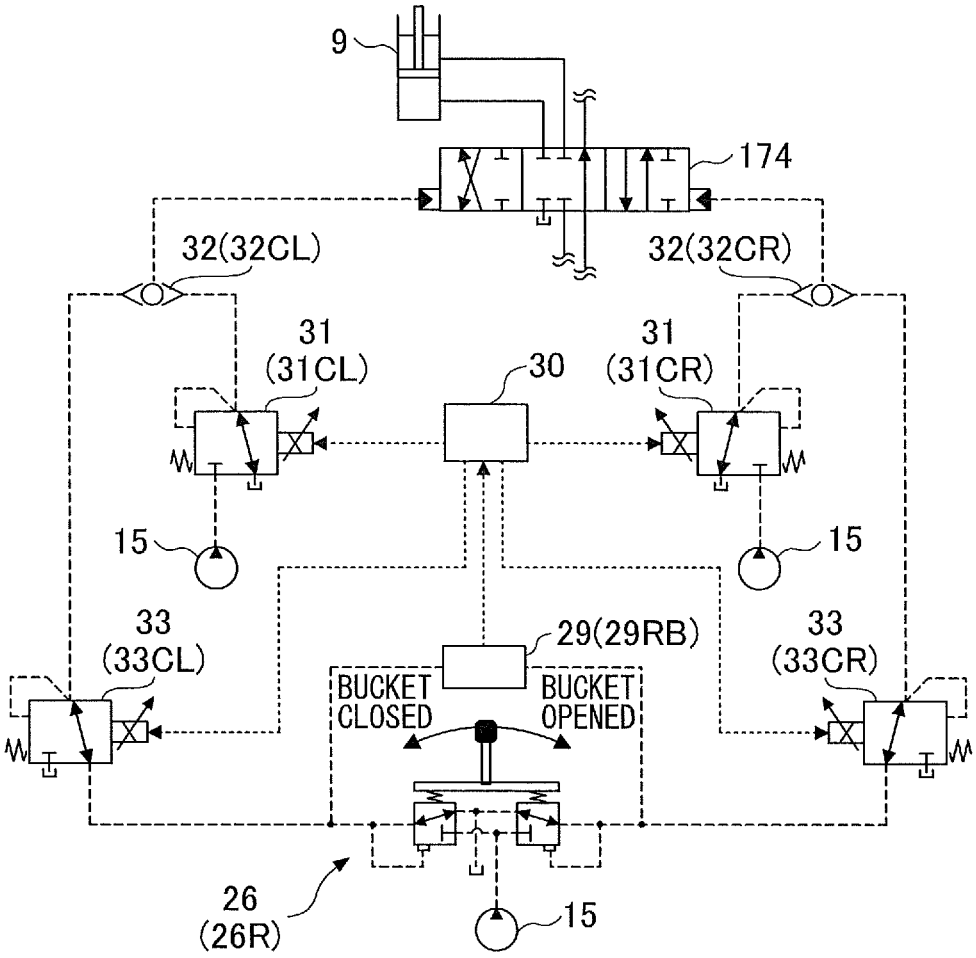
FIG. 5C is a view of a portion of a hydraulic system related to operation of a bucket cylinder.
Figure 5D:
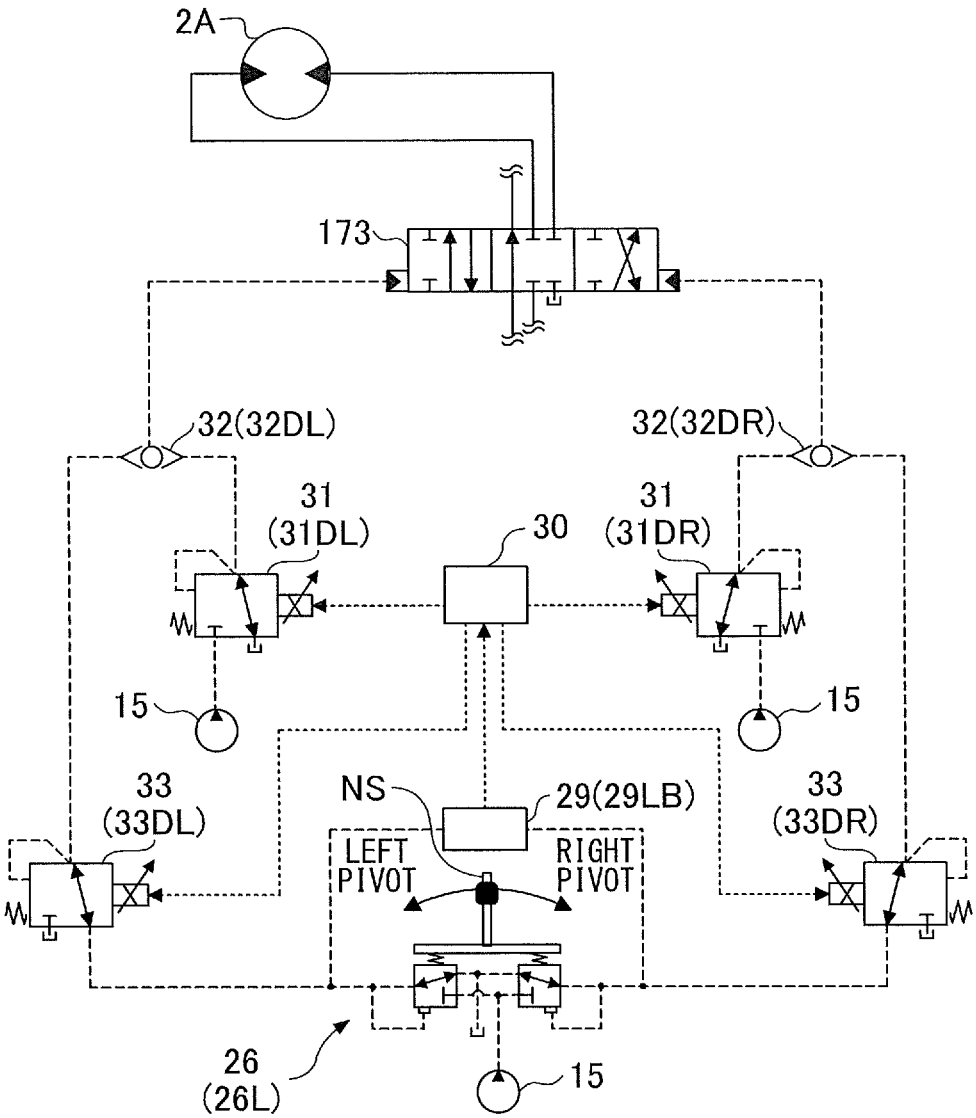
FIG. 5D is a view of a portion of a hydraulic system related to operation of a pivot hydraulic motor.

Next, an arrangement of the controller 30 causing an actuator to operate by means of a machine control function is described with reference to FIGS. 5A to 5D. FIGS. 5A to 5D are views of portions of a hydraulic system. Specifically, FIG. 5A is a view of a portion of the hydraulic system related to operations of the arm cylinder 8, and FIG. 5B is a view of a portion of the hydraulic system related to operations of the boom cylinder 7. FIG. 5C is a view of a portion of the hydraulic system related to operations of the bucket cylinder 9, and FIG. 5D is a view of a portion of the hydraulic system related to operations of the pivot hydraulic motor 2A.

As shown in FIGS. 5A to 5D, the hydraulic system includes a proportional valve 31, a shuttle valve 32 and a proportional valve 33. The proportional valve 31 includes proportional valves 31AL to 31DL and 31AR to 31DR, the shuttle valve 32 includes shuttle valves 32AL to 32DL and 32AR to 32DR, and the proportional valve 33 includes proportional valves 33AL to 33DL and 33AR to 33DR.

The proportional valve 31 functions as a control valve for machine control. The proportional valve 31 is disposed in a conduit for coupling the pilot pump 15 with the shuttle valve 32 and is configured to change the flow area of the conduit. In this embodiment, the proportional valve 31 operates in response to a control command fed from the controller 30. Thus, the controller 30 can supply the hydraulic oil discharged by the pilot pump 15 to the pilot port of the corresponding control valve in the control valve 17 via the proportional valve 31 and the shuttle valve 32, regardless of operator's operations of the operation device 26.

The shuttle valve 32 includes two inlet ports and one outlet port. One of the two inlet ports is coupled to the operation device 26, and the other is coupled to the proportional valve 31. The outlet port is coupled to a pilot port of the corresponding control valve in control valve 17. Thus, the shuttle valve 32 can cause the higher of the pilot pressure generated by the operation device 26 and the pilot pressure generated by the proportional valve 31 to be applied to the corresponding pilot port of the control valve.

Similar to the proportional valve 31, the proportional valve 33 functions as a control valve for machine control. The proportional valve 33 is disposed in a conduit for coupling the operation device 26 with the shuttle valve 32 and is configured to change the flow area of the conduit. In this embodiment, the proportional valve 33 operates in response to a control command fed from the controller 30. Thus, the controller 30 can decrease the pressure of the hydraulic oil discharged by the operation device 26 and supply the resulting hydraulic oil to the pilot port of the corresponding control valve in the control valve 17 via the shuttle valve 32, regardless of operator's operations of the operation device 26.

According to this arrangement, even if no operation is performed on the particular operation device 26, the controller 30 can forcibly stop the operation of a hydraulic actuator corresponding to the particular operation device 26.

For example, as shown in FIG. 5A, the left operation lever 26L is used to operate the arm 5. Specifically, the left operation lever 26L utilizes the hydraulic oil discharged by the pilot pump 15 to apply the pilot pressure corresponding to operations in the forward-backward direction to the pilot port of the control valve 176. More specifically, the left operation lever 26L, if it is operated in the arm closing direction (backward direction), applies the pilot pressure corresponding to the operation amount to the right pilot port of the control valve 176L and the left pilot port of the control valve 176R. Also, if the left operation lever 26L is operated in the arm opening direction (forward direction), the left operation lever 26L applies the pilot pressure corresponding to the operation amount to the left pilot port of the control valve 176L and the right pilot port of the control valve 176R.

A switch NS is provided to the left operation lever 26L. In this embodiment, the switch NS is a push-button switch provided at the tip of the left operation lever 26L. The operator can operate the left operation lever 26L while pressing the switch NS. The switch NS may be provided to the right operation lever 26R or at other locations in the cabin 10.

The operation pressure sensor 29LA detects operational contents of the left operation lever 26L in the forward-backward direction by the operator in the form of pressure and outputs a detected value to the controller 30.

The proportional valve 31AL operates in response to a current command fed from the controller 30. Then, the pilot pressure of the hydraulic oil introduced from the pilot pump 15 to the right pilot port of the control valve 176L and the left pilot port of the control valve 176R through the proportional valve 31AL and the shuttle valve 32AL is adjusted. The proportional valve 31AR operates in response to a current command fed from the controller 30. Then, the pilot pressure of the hydraulic oil introduced from the pilot pump 15 to the left pilot port of the control valve 176L and the right pilot port of the control valve 176R through the proportional valve 31AR and the shuttle valve 32AR is adjusted. The proportional valve 31AR operates in response to a current command fed from the controller 30. Then, the pilot pressure by the hydraulic oil introduced from the pilot pump 15 to the left pilot port of the control valve 176L and the right pilot port of the control valve 176R through the proportional valve 31AR and the shuttle valve 32AR is adjusted. The proportional valves 31AL and 31AR can adjust the pilot pressure so that the control valves 176L and 176R can be stopped at any valve position.

According to this arrangement, the controller 30 can supply the hydraulic oil discharged by the pilot pump 15 to the right pilot port of the control valve 176L and the left pilot port of the control valve 176R through the proportional valve 31AL and the shuttle valve 32AL, regardless of the arm closing operation by the operator. Namely, the arm 5 can be closed. Also, the controller 30 may supply the hydraulic oil discharged by the pilot pump 15 to the left pilot port of the control valve 176L and the right pilot port of the control valve 176R through the proportional valve 31AR and the shuttle valve 32AR, regardless of arm opening operations by the operator. Namely, the arm 5 can be opened.

The proportional valve 33AL operates in response to a control command (current command) fed from the controller 30. Then, the pilot pressure by the hydraulic oil introduced from the pilot pump 15 to the right pilot port of the control valve 176L and the left pilot port of the control valve 176R through the left operation lever 26L, the proportional valve 33AL and the shuttle valve 32AL is decreased. The proportional valve 33AR operates in response to a control command (current command) fed from the controller 30. Then, the pilot pressure by the hydraulic oil introduced from the pilot pump 15 to the left pilot port of the control valve 176L and the right pilot port of the control valve 176R through the left operation lever 26L, the proportional valve 33AR and the shuttle valve 32AR is decreased. The proportional valves 33AL and 33AR can adjust the pilot pressure so that the control valves 176L and 176R can be stopped at any valve position.

According to this arrangement, even if the operator is performing the arm closing operation, the controller 30 can decrease the pilot pressure applied to the closing side pilot ports of the control valve 176 (the left pilot port of the control valve 176L and the right pilot port of the control valve 176R) to forcibly stop the closing operation of the arm 5. The same shall apply to the case where the opening operation of the arm 5 is forcibly stopped while an operator is performing the arm opening operation.

Alternatively, even if the operator is performing the arm closing operation, the controller 30 may control the proportional valve 31AR to increase the pilot pressure applied to opening side pilot ports of the control valve 176 (the right pilot port of the control valve 176L and the left pilot port of the control valve 176R) that are opposite to the closed side pilot port of the control valve 176, forcing the control valve 176 to return to a neutral position to stop the closing operation of the arm 5. In this case, the proportional valve 33AL may be omitted. The same shall apply to the case where the opening operation of the arm 5 is forcibly stopped when an operator is performing the arm opening operation.

Also, although the description with reference to FIGS. 5B to 5D below is omitted, the same shall apply to the case of forcibly stopping the operation of the boom 4 when an operator is performing a boom up operation or a boom down operation, the case of forcibly stopping the operation of the bucket 6 when an operator is performing a bucket closing operation or a bucket opening operation, and the case of forcibly stopping the pivot operation of the upper pivot body 3 when an operator is performing a pivot operation. Also, the same shall apply to the case where the travelling operation of the lower travelling body 1 is forcibly stopped when an operator is performing the travelling operation.

Also, as shown in FIG. 5B, the right operation lever 26R is used to operate the boom 4. Specifically, the right operation lever 26R utilizes the hydraulic oil discharged by the pilot pump 15 to apply the pilot pressure corresponding to operations in the forward-backward direction to the pilot port of the control valve 175. More specifically, the right operation lever 26R, if it is operated in the boom up direction (backward direction), applies the pilot pressure corresponding to the operation amount to the right pilot port of the control valve 175L and the left pilot port of the control valve 175R. Also, if the right operation lever 26R is operated in the boom down direction (forward direction), the right operation lever 26R applies the pilot pressure corresponding to the operation amount to the right pilot port of the control valve 175R.

The operation pressure sensor 29RA detects operational contents of the right operation lever 26R in the forward-backward direction by the operator in the form of pressure and outputs a detected value to the controller 30.

The proportional valve 31BL operates in response to a current command fed from the controller 30. Then, the pilot pressure of the hydraulic oil introduced from the pilot pump 15 into the right pilot port of the control valve 175L and the left pilot port of the control valve 175R through the proportional valve 31BL and the shuttle valve 32BL is adjusted. The proportional valve 31BR operates in response to a current command fed from the controller 30. Then, the pilot pressure of the hydraulic oil introduced from the pilot pump 15 into the left pilot port of the control valve 175L and the right pilot port of the control valve 175R through the proportional valve 31BR and the shuttle valve 32BR is adjusted. The proportional valves 31BL and 31BR can adjust the pilot pressure so that the control valves 175L and 175R can be stopped at any valve position.

According to this arrangement, the controller 30 can supply the hydraulic oil discharged by the pilot pump 15 to the right pilot port of the control valve 175L and the left pilot port of the control valve 175R through the proportional valve 31BL and the shuttle valve 32BL, regardless of operator's boom up operations. Namely, the boom 4 can be raised. Also, the controller 30 can supply the hydraulic oil discharged by the pilot pump 15 to the right pilot port of the control valve 175R through the proportional valve 31BR and the shuttle valve 32BR, regardless of operator's boom down operations. Namely, the boom 4 can be lowered.

Also, as shown in FIG. 5C, the right operation lever 26R is used to operate the bucket 6. Specifically, the right operation lever 26R utilizes the hydraulic oil discharged by the pilot pump 15 to apply the pilot pressure corresponding to operations in the right-left direction to the pilot port of the control valve 174. More specifically, the right operation lever 26R, if it is operated in the bucket closing direction (left direction), causes the pilot pressure corresponding to the operation amount to be applied to the left pilot port of the control valve 174. Also, the right operation lever 26R, if it is operated in the bucket opening direction (right direction), the right operation lever 26R causes the pilot pressure corresponding to the operation amount to be applied to the right pilot port of the control valve 174.

The operation pressure sensor 29RB detects operational contents of the right operation lever 26R in the right-left direction by the operator in the form of pressure and outputs a detected value to the controller 30.

The proportional valve 31CL operates in response to a current command fed from the controller 30. Then, the pilot pressure of the hydraulic oil introduced from the pilot pump 15 to the left pilot port of the control valve 174 through the proportional valve 31CL and the shuttle valve 32CL is adjusted. The proportional valve 31CR operates in response to a current command fed from the controller 30. Then, the pilot pressure of the hydraulic oil introduced from the pilot pump 15 to the right pilot port of the control valve 174 via the proportional valve 31CR and the shuttle valve 32CR is adjusted. The proportional valves 31CL and 31CR can adjust the pilot pressure so that the control valve 174 can be stopped at any valve position.

According to this arrangement, the controller 30 can supply the hydraulic oil discharged by the pilot pump 15 to the left pilot port of the control valve 174 via the proportional valve 31CL and the shuttle valve 32CL, regardless of operator's bucket closing operations. Namely, the bucket 6 can be closed. Also, the controller 30 can supply the hydraulic oil discharged by the pilot pump 15 to the right pilot port of the control valve 174 through the proportional valve 31CR and the shuttle valve 32CR, regardless of operator's bucket opening operations. Namely, the bucket 6 can be opened.

Also, as shown in FIG. 5D, the left operation lever 26L is used to operate the pivot mechanism 2. Specifically, the left operation lever 26L utilizes the hydraulic oil discharged by the pilot pump 15 to apply the pilot pressure corresponding to an operation in the left-right direction to the pilot port of the control valve 173. More specifically, the left operation lever 26L, if it is operated in the left pivot direction (left direction), applies the pilot pressure corresponding to the operation amount to the left pilot port of the control valve 173. Also, if the left operation lever 26L is operated in the right pivot direction (right direction), the left operation lever 26L applies the pilot pressure corresponding to the operation amount to the right pilot port of the control valve 173.

The operation pressure sensor 29LB detects operational contents of the left operation lever 26L in the left-right direction by the operator in the form of pressure and outputs a detected value to the controller 30.

The proportional valve 31DL operates in response to a current command fed from the controller 30. Then, the pilot pressure of the hydraulic oil introduced from the pilot pump 15 to the left pilot port of the control valve 173 through the proportional valve 31DL and the shuttle valve 32DL is adjusted. The proportional valve 31DR operates in response to a current command fed from the controller 30. Then, the pilot pressure of the hydraulic oil introduced from the pilot pump 15 to the right pilot port of the control valve 173 via the proportional valve 31DR and the shuttle valve 32DR is adjusted. Then, the proportional valve 31DL and 31DR can adjust the pilot pressure so that the control valve 173 can be stopped at any valve position.

According to this arrangement, the controller 30 can supply the hydraulic oil discharged by the pilot pump 15 to the left pilot port of the control valve 173 through the proportional valve 31DL and the shuttle valve 32DL, regardless of operator's left pivot operations. Namely, the pivot mechanism 2 can be pivoted in the left direction. Also, the controller 30 can supply the hydraulic oil discharged by the pilot pump 15 to the right pilot port of the control valve 173 through the proportional valve 31DR and the shuttle valve 32DR, regardless of operator's right pivot operations. Namely, the pivot mechanism 2 can be pivoted in the right direction.

The shovel 100 may be configured to automatically advance and reverse the lower travelling body 1. In this case, a hydraulic system portion related to operations of the left travelling hydraulic motor 2ML and a hydraulic system portion related to operations of the right travelling hydraulic motor 2MR may be configured in the same manner as a hydraulic system portion related to operations of the boom cylinder 7.

Figure 6:
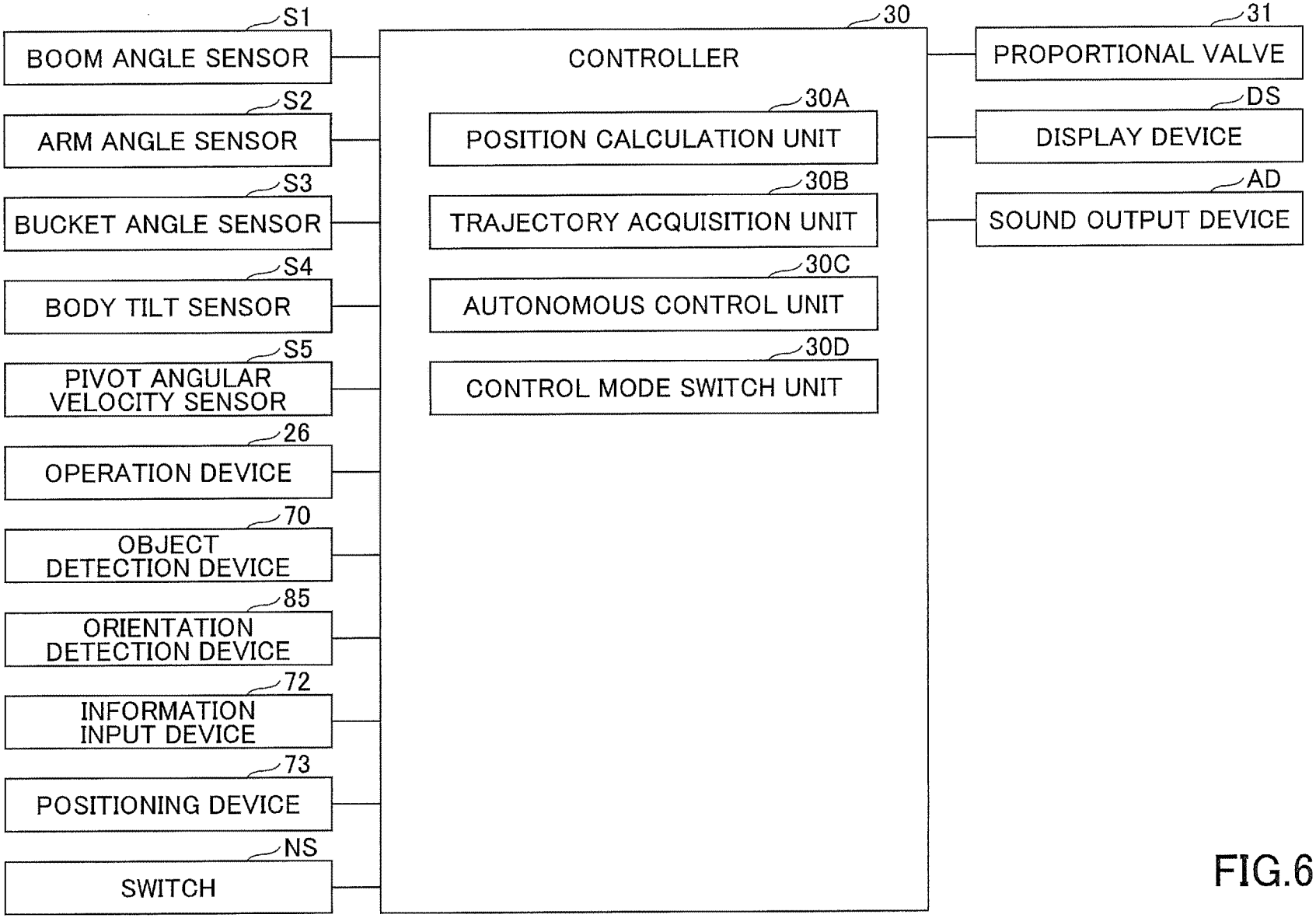
FIG. 6 is a functional block diagram of a controller.

Next, a function of the controller 30 is described with reference to FIG. 6. FIG. 6 is a functional block diagram of the controller 30. In the example of FIG. 6, the controller 30 is configured to receive signals fed from at least one of the posture detection device, the operation device 26, the object detection device 70, the orientation detection device 85, the information input device 72, the positioning device 73, the switch NS and others, perform various operations, and output control commands to at least one of the proportional valve 31, the display device DS, the sound output device AD and others. The posture detection device includes a boom angle sensor S1, an arm angle sensor S2, a bucket angle sensor S3, a body tilt sensor S4 and a pivot angular velocity sensor S5. The controller 30 has a position calculation unit 30A, a trajectory acquisition unit 30B, an autonomous control unit 30C and a control mode switch unit 30D as functional elements. Each functional element may be composed of hardware or software.

The information input device 72 is configured so that an operator of the shovel can input information to the controller 30. In this embodiment, the information input device 72 is a switch panel DS2 disposed adjacent to an image display unit DS1 of the display device DS. However, the information input device 72 may be a sound input device, such as a microphone, disposed in the cabin 10.

The positioning device 73 is configured to measure the position of the upper pivot body 3. In this embodiment, the positioning device 73 is a GNSS receiver that detects the position of the upper pivot body 3 and outputs a detected value to the controller 30. The positioning device 73 may be a GNSS compass. In this case, the positioning device 73 can detect the position and orientation of the upper pivot body 3.

The position calculation unit 30A is configured to calculate the position of a to-be-positioned target. In this embodiment, the position calculation unit 30A calculates the coordinate point in a reference coordinate system of a predetermined portion of an attachment. The predetermined portion may be, for example, the claw edge of the bucket 6. The origin of the reference coordinate system may be, for example, the intersection of the pivot axis and the ground plane of the shovel 100. The position calculation unit 30A calculates the coordinate point of the claw edge of the bucket 6 from the respective rotation angles of the boom 4, the arm 5 and the bucket 6, for example. The position calculation unit 30A may calculate not only the coordinate point of the center of the claw edge of the bucket 6 but also the coordinate point of the left end of the claw edge of the bucket 6, and the coordinate point of the right end of the claw edge of the bucket 6. In this case, the position calculation unit 30A may utilize an output of the body tilt sensor S4.

The trajectory acquisition unit 30B is configured to acquire a target trajectory as a traversed trajectory of the predetermined portion of an attachment at autonomously operating the shovel 100. In this embodiment, the trajectory acquisition unit 30B acquires the target trajectory used when the autonomous control unit 30C autonomously operates the shovel 100.

Specifically, the trajectory acquisition unit 30B derives the target trajectory based on data concerning a target construction surface stored in a non-volatile storage device. The trajectory acquisition unit 30B may derive the target trajectory based on information regarding the terrain around the shovel 100 recognized by the object detection device 70. Alternatively, the trajectory acquisition unit 30B may derive information regarding the past trajectory of the claw edge of the bucket 6 from a past output of the posture detection device stored in a volatile storage device and derive the target trajectory based on that information. Alternatively, the trajectory acquisition unit 30B may derive the target trajectory based on the current position of a predetermined portion of the attachment and the data regarding the target construction plane.

The autonomous control unit 30C is configured to operate the shovel 100 autonomously. In this embodiment, if a predetermined activation condition is satisfied, the autonomous control unit 30C is configured to move a predetermined portion of the attachment along the target trajectory acquired by the trajectory acquisition unit 30B. Specifically, when the operation device 26 is operated while the switch NS is pressed, the shovel 100 is operated autonomously so that the predetermined portion moves along the target trajectory.

In this embodiment, the autonomous control unit 30C is configured to assist an operator in manually operating the shovel by autonomously operating an actuator. For example, if the operator manually performs an arm closing operation while pressing the switch NS, the autonomous control unit 30C may autonomously expand or contract at least one of the boom cylinder 7, the arm cylinder 8 and the bucket cylinder 9 so that the target trajectory coincides with the position of the claw edge of the bucket 6. In this case, the operator can close the arm 5 while aligning the claw edge of the bucket 6 with the target trajectory by simply operating the left operation lever 26L in the arm closing direction, for example. In this example, the arm cylinder 8, which is a main operation target, is referred to as a "main actuator." Also, the boom cylinder 7 and the bucket cylinder 9, which are driven according to the movement of the main actuator, are referred to as "dependent actuators."

In this embodiment, the autonomous control unit 30C can operate each actuator autonomously by providing a current command to the proportional valve 31 to adjust the pilot pressure applied to the control valve corresponding to the actuator individually. For example, at least one of the boom cylinder 7 and the bucket cylinder 9 can be operated regardless of whether the right operation lever 26R is tilted.

The control mode switch unit 30D is configured to be capable of switching the control mode. The control mode is a control method for an actuator available to the controller 30 when the autonomous control unit 30C causes the shovel 100 to operate autonomously, including, for example, a normal control mode and a slow control mode. The normal control mode may be, for example, a control mode where the movement speed of a predetermined portion relative to an operation amount of the operation device 26 is set to be relatively large, and the slow control mode where the movement speed of the predetermined portion relative to the operation amount of the operation device 26 is set to be relatively small. The control mode may include an arm priority mode and a boom priority mode.

Any control mode is utilized when the operation device 26 is operated during the switch NS being pressed. For example, the arm priority mode is a control mode where the arm cylinder 8 is selected as the main actuator and the boom cylinder 7 and the bucket cylinder 9 are selected as the dependent actuators. In the arm priority mode, for example, when the left control lever 26L is operated in the arm closing direction, the controller 30 actively extends the arm cylinder 8 at a speed proportional to the operation amount of the left operation lever 26L. Then, the controller 30 passively expands and contracts at least one of the boom cylinder 7 and the bucket cylinder 9 such that the claw edge of the bucket 6 moves along the target trajectory. The boom priority mode is a control mode where the boom cylinder 7 is selected as the main actuator and the arm cylinder 8 and the bucket cylinder 9 are selected as the dependent actuators. In the boom priority mode, for example, when the left operation lever 26L is operated in the arm closing direction, the controller 30 actively expands and contracts the boom cylinder 7 at a speed proportional to the operation amount of the left operation lever 26L. Then, the controller 30 passively extends the arm cylinder 8 so that the claw edge of the bucket 6 moves along the target trajectory and, if necessary, passively expands and contracts the bucket cylinder 9. Note that the control mode may include a bucket priority mode. The bucket priority mode is a control mode where the bucket cylinder 9 is selected as the main actuator and the boom cylinder 7 and the arm cylinder 8 are selected as the dependent actuators. In the bucket priority mode, for example, when the left operation lever 26L is operated in the arm closing direction, the controller 30 actively expands and contracts the bucket cylinder 9 at a speed proportional to the operational amount of the left operation lever 26L. Then, the controller 30 passively extends the arm cylinder 8 so that the claw edge of the bucket 6 moves along the target trajectory and, if necessary, passively expands and contracts the boom cylinder 7.

The control mode switch unit 30D may be configured to, if a predetermined condition is satisfied, automatically switch the control mode. The predetermined condition may be set based on, for example, the shape of the target trajectory, the presence or absence of a buried object, the presence or absence of an object around the shovel 100, or the like.

When the autonomous control is started, for example, the controller 30 first adopts a first control mode. The first control mode may be, for example, the normal control mode. Then, if it is determined that a predetermined condition is satisfied during execution of the autonomous control in the first control mode, the control mode switch unit 30D switches the control mode from the first control mode to a second control mode. The second control mode may be, for example, the slow control mode. In this case, the controller 30 terminates the autonomous control employing the first control mode and starts the autonomous control employing the second control mode. In this example, the controller 30 may select one of the two control modes to perform the autonomous control, but may select one of three or more control modes to perform the autonomous control.

The controller 30 may be configured to use the hydraulic system described above to automatically control a drive portion of the shovel 100 as desired. The automatic control of the drive portion may include, for example, forcing down or stopping the movement of the drive portion, even if the operation device 26 is operated for the drive portion.

The controller 30 may, for example, be configured to automatically brake a drive unit when the object detection device 70 detects an object. In this case, the drive unit may include, for example, at least one of a pivot hydraulic motor 2A and a travelling hydraulic motor 2M. The braking of the drive unit may be realized, for example, by switching the pilot line CD1 from the connection state to the disconnection state by means of the control valve 60 while the operation device 26 is being operated. This is because the control valves corresponding to the operated operation device 26 returns to a neutral valve position. Note that the braking of the drive unit may include at least one of reducing the operation speed of the drive unit and stopping the movement of the drive unit.

The controller 30 may be configured to, if a predetermined condition is satisfied while the drive unit is being braked, release the braking of the drive unit.

The case where "the drive unit is being braked" may include, for example, a case where the operation speed of the drive unit is reduced, a case where the movement of the drive unit is stopped, and a case where the stop of the drive unit is maintained. Specifically, the case where "the drive unit is being braked" may include a case where the control valve 60 is positioned between first and second valve positions and a case where the control valve 60 is positioned at the second valve position. However, the case where the movement speed of the drive unit is reduced, that is, the case where the control valve 60 is positioned between the first and second valve positions may be excluded.

The case where a predetermined condition is satisfied" may be a case where it is determined that an operator has the intention to continue the operation. For example, in the case where the travelling hydraulic motor 2M is braked during operating the travelling lever 26D in the backward direction, in response to the travelling lever 26D in the backward direction being re-operated, the controller 30 may determine that the operator has the intention to continue the operation. In this case, "re-operation" may mean that the travelling lever 26D is operated back to the neutral position and is subsequently operated in the backward direction again, that the travelling lever 26D is operated in the forward direction beyond the neutral position and is subsequently operated in the backward direction again, or that the travelling lever 26D is operated toward the neutral position and is subsequently operated in the backward direction again.

In this case, the controller 30 may determine whether the operation device 26 is re-operated based on an output of the operation pressure sensor 29. Alternatively, the controller 30 may determine whether the operation device 26 is re-operated based on an output of a device other than the operation pressure sensor 29, such as an indoor capturing device for capturing an operator in the cabin 10.

Alternatively, if the operation device 26 is operated in a predetermined operation manner with respect to the to-be-braked drive unit, the controller 30 may determine that the operator has the intention to continue the operation. For example, in the case where the pivot hydraulic motor 2A is braked during the left operation lever 26L being operated in the right pivot direction, in response to the left operation lever 26L being reciprocally operated twice between the left direction and the right direction, the controller 30 may determine that the operator has the intention to continue the operation. Specifically, when the left operation lever 26L is operated in the order of the left pivot direction, the right pivot direction, the left pivot direction, and the right pivot direction, it may be determined that the left operation lever 26L is deemed to have been operated in the predetermined manner and the operator has the intention to continue the operation.

Alternatively, if the operation device 26 is re-operated during the lever button LB provided in the operation device 26 with respect to the to-be-braked drive unit being pressed, the controller 30 may determine that the operator has the intention to continue the operation. For example, in the case where the boom cylinder 7 is braked during the right operation lever 26R being operated in the boom down direction, in response to the right operation lever 26R being re-operated in the boom down direction during the lever button LB provided to the right operation lever 26R being pressed, the controller 30 may determine that the operator has the intention to continue the operation.

Figure 7:
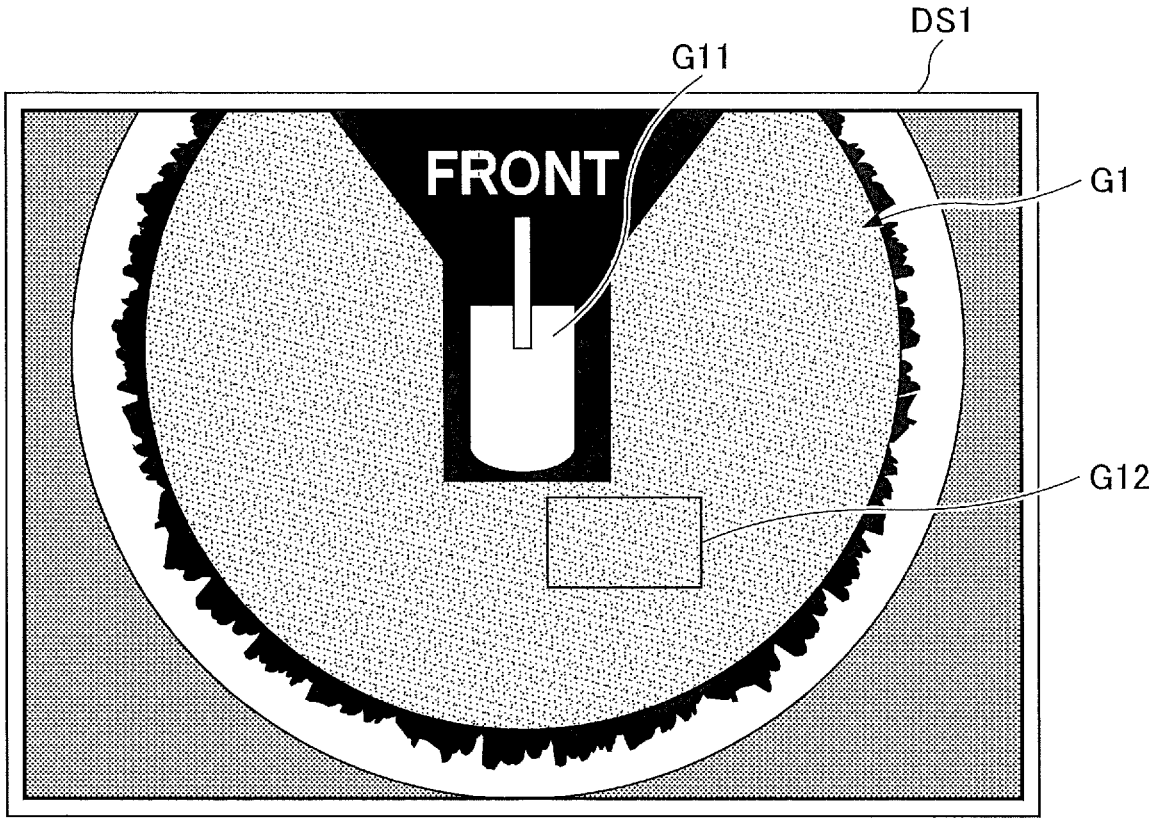
FIG. 7 is a diagram for illustrating one exemplary display screen.

Next, a typical situation when the braking of the drive unit is deactivated is described with reference to FIG. 7. FIG. 7 shows an exemplary arrangement of a display screen displayed on the image display unit DS1 of the display device DS when the controller 30 determines that an object exists around the shovel 100.

If determining that an object exists around the shovel 100 based on an output of the object detection device 70, the controller 30 outputs a brake command to the control valve 60 to change the connection state of the pilot line CD1 into the disconnection state. In this case, the controller 30 may brake all currently operating hydraulic actuators. Therefore, for example, the travelling hydraulic motor 2M is forcibly braked, and the backward moving shovel 100 is stopped. At this time, the controller 30 displays a bird's-eye image G1 on the image display unit DS1, which is synthesized based on an image captured by the capturing device 80.

The bird's-eye image G1 may be, for example, a virtual viewpoint image illustrating a state in which the shovel and its surroundings are viewed from directly above, and may include a shovel figure G11 and a frame G12. The shovel figure G11 is a shape corresponding to the shovel 100. The frame G12 is a figure in which it is superimposed to surround the position on the display screen corresponding to the actually existing position of an object detected by the object detection device 70. By viewing an image portion surrounded by the frame G12, the operator of the shovel 100 can confirm the position and type of the object that caused the drive unit to be braked. The controller 30 may superimpose an image other than the frame G12 so that the operator can identify the object detected by the object detection device 70.

In FIG. 7, an example where the bird's-eye image G1 is used to display the frame 12 is shown, but the controller 30 may use a rear camera image captured by the rear camera 80B instead of the bird's-eye image G1. Also, the controller 30 may use not only the rear camera image captured by the rear camera 80B but also a right camera image captured by the right camera 80R and a left camera image captured by the left camera 80L. Also, the controller 30 may display a camera image captured by a camera corresponding to the detected area of an object.

However, in the example of FIG. 7, only an image of the ground is displayed in the frame G12, and no image of any object is displayed. Therefore, by viewing the display screen shown in FIG. 7, the operator can recognize that the present brake is caused due to erroneous detection of an object. There are cases where the erroneous detection of objects may be caused due to environmental conditions such as sunlight, rain, dust, and the like. In this case, the operator can deactivate the braking of the drive unit by informing the controller 30 that the operator has the intention to continue the operation as described above. For example, the backward movement of the shovel 100 may be restarted by deactivating the braking of the drive unit without releasing his hand from the travelling lever 26D.

Figure 8:
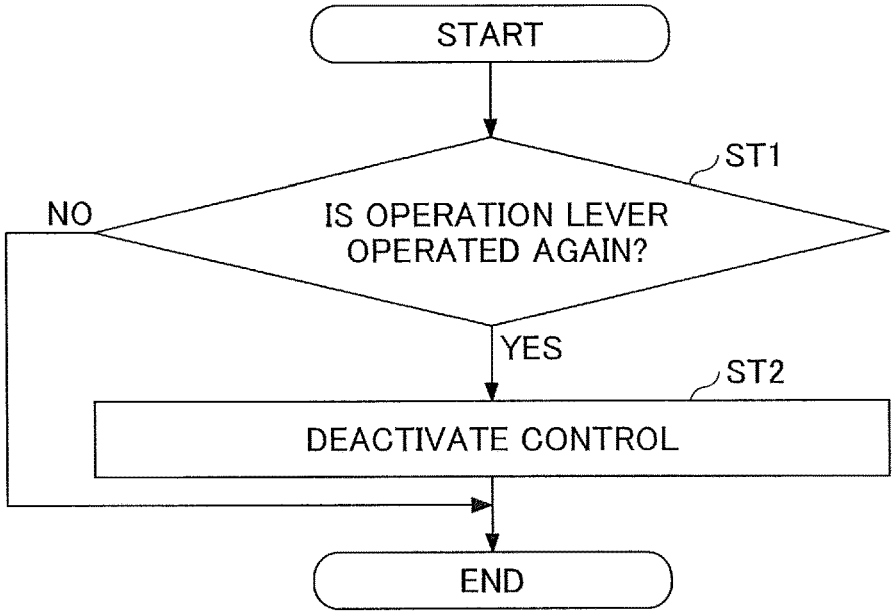
FIG. 8 is a flowchart of an exemplary control deactivation operation.

Next, one exemplary operation for the controller 30 to deactivate braking (hereinafter referred to as an "brake deactivation operation") is described with reference to FIG. 8. FIG. 8 is a flowchart for illustrating one exemplary brake deactivation operation. For example, the controller 30 may repeatedly perform the brake deactivation operation during braking the drive unit. Specifically, the brake deactivation operation may be performed repeatedly while a brake command is fed to the control valve 60.

First, the controller 30 determines whether the operation lever has been re-operated (step ST1). In this embodiment, the controller 30 determines whether the operation lever has been re-operated based on an output of the operation pressure sensor 29. For example, during the backward movement of the shovel 100, that is, if the travelling lever 26D is operated in the backward direction, in response to determining that there is an object behind the shovel 100, the controller 30 outputs a brake command to the control valve 60. At this time, if the travelling lever 26D is returned to the neutral position and is subsequently operated in the backward direction again, the controller 30 determines that the travelling lever 26D is re-operated.

Upon determining that the operation lever has not been re-operated (No in step ST1), the controller 30 terminates the current brake deactivation operation. Therefore, the drive unit is continuously braked.

Upon determining that the operation lever has been re-operated (YES in step ST1), the controller 30 deactivates the braking (step ST2). This is because it can be determined that the operator has the intention to continue the operation. For example, if the travelling lever 26D is operated back to the neutral position and is subsequently is operated in the backward direction, the controller 30 can determine that the operator intends to continue the backward operation. In this embodiment, the controller 30 outputs a deactivation command to the control valve 60 and changes the pilot line CD1 back to the connection state to deactivate the braking.

The controller 30 may limit the period for which the braking is allowed to be deactivated. The controller 30 may, for example, be configured to, only if the operation lever is re-operated in the case of the elapsed time from the time point of outputting a brake command for the control valve 60 being longer than or equal to a predetermined lower limit time and shorter than or equal to a predetermined upper time, allow the braking to be deactivated.

According to this arrangement, even in the case where the controller 30 determines that an object exists around the shovel 100 and forcibly brakes the drive unit, upon determining that an operator intends to continue the operation, the controller 30 can deactivate the braking. Therefore, for example, if the operator can recognize that the driving unit has been braked due to the erroneous detection of an object, the operator can deactivate the braking of the driving unit without releasing his/her hand from the operation device 26 and restart the movement of the driving unit.

Figure 9:
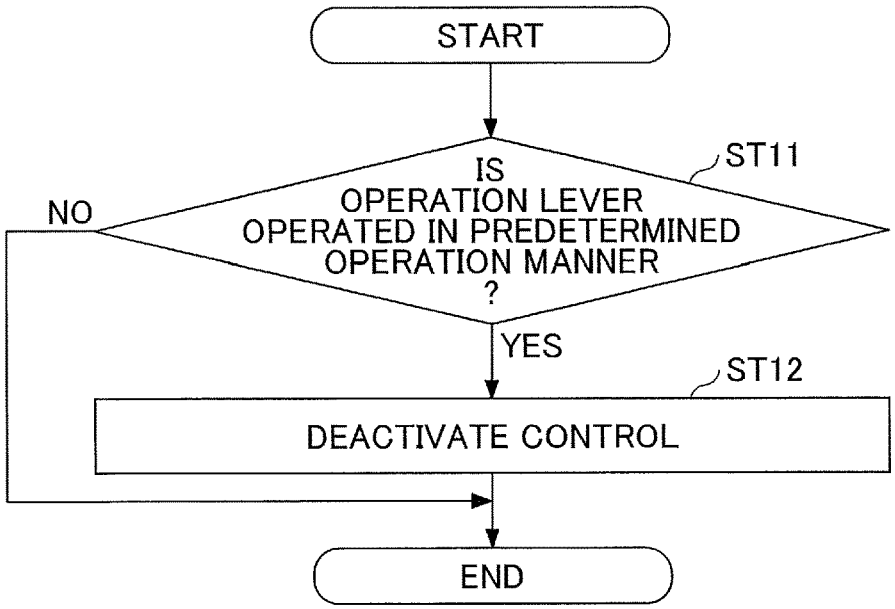
FIG. 9 is a flowchart of another exemplary control deactivation operation.

Next, another exemplary brake deactivation operation is described with reference to FIG. 9. FIG. 9 is a flowchart for illustrating another exemplary brake deactivation operation. For example, the controller 30 repeatedly performs the brake deactivation operation during braking the drive. Specifically, the controller 30 repeatedly performs the brake deactivation operation during feeding brake commands to the control valve 60.

Initially, the controller 30 determines whether the operation lever has been operated in a predetermined manner (step ST11). In this embodiment, the controller 30 determines whether the operation lever has been re-operated multiple times based on outputs of the operation pressure sensor 29. For example, while the shovel 100 is performing the right pivot operation, that is, when it is determined that there is an object to the right side of the shovel 100 during the left operation lever 26L being operated in the right pivot direction, the controller 30 outputs a brake command to the control valve 60. At this time, if the left operation lever 26L is re-operated in the right pivot direction multiple times, the controller 30 determines that the left operation lever 26L has been operated in the predetermined operation manner. Specifically, if the left operation lever 26L is operated to vibrate the left operation lever 26L to the left and right in the order of the left pivot direction, the right pivot direction, the left pivot direction and the right pivot direction, the controller 30 determines that the left operation lever 26L has been operated in the predetermined operation manner.

If it is determined that the operation lever is not operated by the predetermined operation manner (No in step ST11), the controller 30 terminates the brake deactivation operation. Therefore, the drive unit remains braked.

If it is determined that the operation lever has been operated in the predetermined operation manner (YES in step ST11), the controller 30 deactivates the braking (step ST12). This is because it can be determined that the operator has the intention to continue the operation. For example, if the left operation lever 26L is re-operated in the right pivot direction twice, the controller 30 can determine that the operator intends to continue the right pivot operation. In this embodiment, the controller 30 deactivates the braking by outputting a brake command to the control valve 60 to restore the pilot line CD1 to the connection state.

For example, if the left operation lever 26L is operated in the arm opening direction, then is operated in the arm closing direction and is operated in the right pivot direction again, the controller 30 may determine that the left operation lever 26L has been operated in the predetermined manner. In this case, the operator can deactivate the braking of the pivot hydraulic motor 2A by operating the left operation lever 26L to vibrate back and forth and then operating the left operation lever 26L again in the right pivot direction. Note that the controller 30 may limit the period during which the braking is allowed to be deactivated, as in the case of the brake deactivation operation illustrated in FIG. 8.

According to this arrangement, even in the case where the controller 30 determines that an object exists around the shovel 100 and forcibly brakes the drive unit, if the controller 30 can determine that the operator intends to continue the operation, the controller 30 can deactivate the braking of the drive unit. Therefore, for example, when the operator can recognize that the driving unit has been braked due to the erroneous detection of an object, the operator can deactivate the braking of the driving unit without releasing his/her hand from the operation device 26 and restart the movement of the driving unit.

Figure 10:
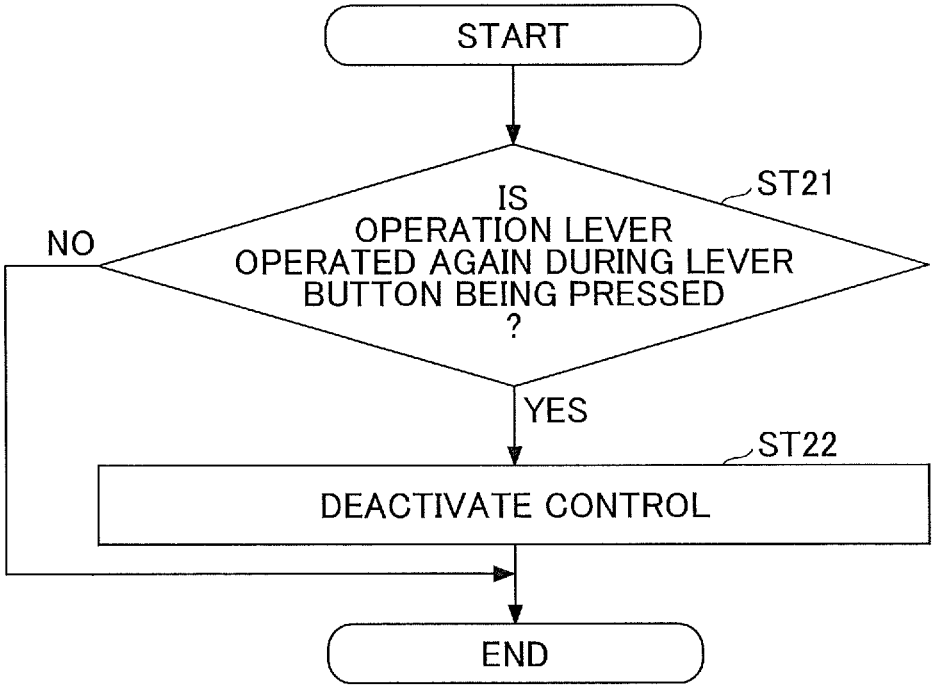
FIG. 10 is a flowchart of a still further exemplary deactivation operation.

Next, another exemplary brake deactivation operation is described with reference to FIG. 10. FIG. 10 is a flowchart of a still further exemplary brake deactivation operation. For example, the controller 30 may repeatedly perform the brake deactivation operation during braking the drive unit. Specifically, the brake deactivation operation may be performed repeatedly during feeding a brake command to the control valve 60.

Initially, the controller 30 determines whether the operation lever has been re-operated during the lever button LB being pressed (step ST21). In this embodiment, the controller 30 determines whether the lever button LB is pushed based on an output of the lever button LB and determines whether the operation lever has been re-operated based on an output of the operation pressure sensor 29. For example, in the case where the shovel 100 is being pivoted in the left pivot direction, that is, in the case where the left operation lever 26L is being operated in the left pivot direction, the leftward swivel operation of the shovel 100, upon determining that there is an object in the left side of the shovel 100, the controller 30 outputs a brake command to the control valve 60. At this time, if the left operation lever 26L is restored to a neutral position during the lever button LB being pressed and is subsequently operated in the left pivot direction again, the controller 30 determines that the left operation lever 26L is re-operated in the left pivot direction during the lever button LB being pressed.

If it is determined that the lever button LB is not pressed or if it is determined that the operation lever has not been re-operated (NO in the step ST21), the controller 30 terminates the present brake deactivation operation. Therefore, the drive unit remains braked.

If it is determined that the operation lever has been re-operated during the lever button LB being pressed (YES in step ST21), the controller 30 deactivates the braking (step ST22). This is because it can be determined that the operator has the intention to continue the operation. For example, if the left operation lever 26L is restored to a neutral position during the lever button LB being pressed and is subsequently operated in the left pivot direction again, the controller 30 can determine that the operator intends to continue the left pivot operation. In this embodiment, the controller 30 deactivates the braking by outputting a deactivation command to the control valve 60 to restore the pilot line CD1 to the connection state. Note that the controller 30 may limit the period during which the braking is allowed to be deactivated, as in the case of the brake deactivation operation illustrated in FIGS. 8 and 9.

According to this arrangement, even in the case where the controller 30 determines that an object exists around the shovel 100 and forcibly brakes the drive unit, upon determining that the operator has the intention to continue the operation, the controller 30 can deactivate the braking of the drive unit. Therefore, for example, if the operator can recognize that the driving unit has been braked due to the erroneous detection of an object, the operator can deactivate the braking of the driving unit without releasing his/her hand from the operation device 26 and restart the movement of the driving unit.

Figure 11:
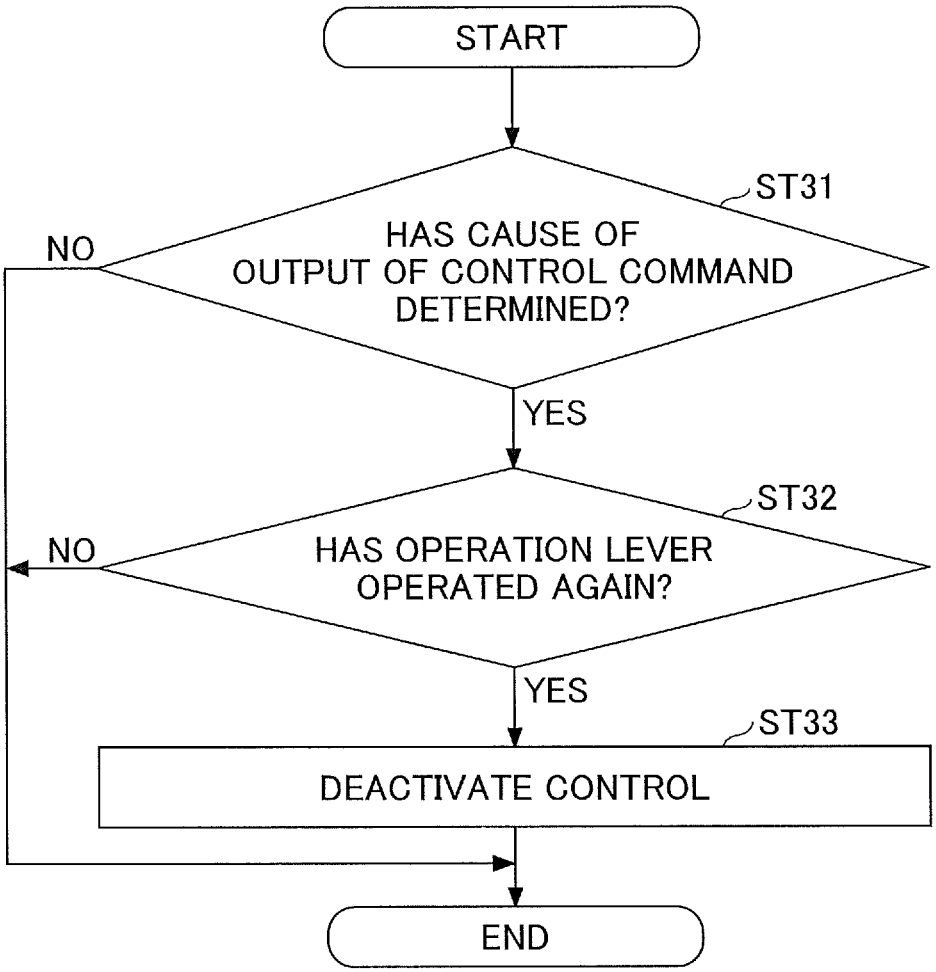
FIG. 11 is a flowchart of a still further exemplary deactivation operation.

Next, another exemplary brake deactivation operation is described with reference to FIG. 11. FIG. 11 is a flowchart of another exemplary brake deactivation operation. For example, the controller 30 may repeatedly perform the brake deactivation operation during braking the drive unit. Specifically, the brake deactivation operation may be performed repeatedly during feeding a brake command to the control valve 60.

Initially, the controller 30 determines whether the cause of the brake command has been checked (step ST31). In this embodiment, the controller 30 checks the behavior of an operator of the shovel 100 during braking the drive unit based on an output of an indoor capturing device (not shown) located inside the cabin 10. The indoor capturing device is configured to capture, for example, the face of the operator seated in the operator's seat. Then, for example, the controller 30 may determine whether the operator has visually confirmed the direction toward a detected object based on an image captured by the indoor capturing device. For example, the controller 30 may determine whether the operator has confirmed the direction toward the detected object by looking based on the operator's line of sight derived from the image processing. Then, if the controller 30 determines that the operator has confirmed the direction toward the detected object by looking, the controller 30 determines that confirmation of the cause of the brake command being output has been performed. For example, if it is determined that there is an object behind the shovel 100 during backward travelling, that is, during the travelling lever 26D being operated in the backward direction, the controller 30 outputs a brake command to the control valve 60. At this time, if the controller 30 can recognize that the operator has acts the backward confirmation based on the image captured by the indoor capturing device, the controller 30 determines that the operator has confirmed the object existing behind the shovel 100, which is the cause of the brake command being output.

If it is determined that the cause of the brake command being output has not been confirmed (No in step ST31), the controller 30 terminates the present brake deactivation operation. Therefore, the drive unit remains braked.

If it is determined that the cause of the brake command being output has been confirmed (YES in step ST31), the controller 30 determines whether the operation lever has been re-operated (step ST32). In this embodiment, the controller 30 determines whether the operation lever has been re-operated based on an output of the operation pressure sensor 29.

If it is determined that the operation lever has not been re-operated (No in step ST32), the controller 30 terminates the present brake deactivation operation. Therefore, the drive unit remains braked.

If it is determined that the operation lever has been re-operated (YES in step ST32), the controller 30 deactivates the braking (step ST33). This is because since the operation lever is restarted after the confirmation of the cause of the brake command being output, the controller 20 can determine that the operator has the intention to continue the operation. In this embodiment, the controller 30 deactivates the braking by feeding a deactivation command to the control valve 60 to restore the pilot line CD1 to the connection state. Note that the controller 30 may limit the period during which the braking is allowed to be deactivated, as in the case of the brake deactivation operation illustrated in FIGS. 8 to 10.

According to this arrangement, even in the case where the controller 30 determines that an object exists around the shovel 100 and forcibly brakes the drive unit, upon determining that the operator has the intention to continue the operation, the controller 30 can deactivate the braking of the drive unit. Therefore, for example, if it can be recognized that the driving unit has been braked due to the erroneous detection of an object, the operator can deactivate the braking of the driving unit without releasing his/her hand from the operation device 26 and restart the movement of the driving unit.

In this manner, the shovel according to an embodiment of the present invention includes a lower travelling body 1, an upper pivot body 3 pivotably mounted to the lower travelling body 1, an object detection device 70 provided to the upper pivot body 3, and a controller 30 that brakes a drive unit of the shovel 100. For example, the drive unit of the shovel 100 may be at least one of a hydraulic actuator and an electric actuator. The controller 30 is configured to, when the object detection device 70 detects an object, automatically brake the drive unit. Then, when it is determined that an operator has an intention to continue operation during execution of the braking of the drive unit, deactivate the braking of the drive unit. According to this arrangement, the shovel 100 can deactivate a state of movement of the shovel 100 being limited more easily. As a result, the work efficient of the shovel can be enhanced.

When an operation lever is re-operated, the controller may determine that the operator has the intention to continue the operation. In this case, if the operation lever is operated in the first operation direction multiple times, the controller 30 may determine that the operation lever is re-operated. Alternatively, if the operation lever has been operated in the first operation direction for longer than or equal to a certain time, the controller 30 may determine that the operation lever is re-operated.

Alternatively, when an operation lever has been re-operated in a state of a predetermined switch being operated, the controller determines that the operator has the intention to continue the operation. For example, when the operation lever is re-operated in the state where the lever button LB provided to the tip of the operation lever is pressed, the controller 30 may determine that the operator has the intention to continue the operation.

Alternatively, the controller may determine presence of the operator's intention to continue the operation based on an image captured by an indoor capturing device that captures an interior in the cabin 10. For example, the controller 30 may determine the presence of the operator's intention to continue the operation based on contents of the behavior of the operator during the drive unit being braked.

Alternatively, the controller may determine presence of the operator's intention to continue the operation based on sound recognized by a sound recognition device. For example, the controller 30 may determine the presence of the operator's intention to continue the operation based on verbal contents uttered by the operator during the drive unit being braked.

According to the above-stated arrangement, the controller 30 can determine the presence of the operator's intention to continue the operation accurately. Therefore, the state of the restricted movement of the shovel 100 can be deactivated easily while the restriction can be prevented from being erroneously deactivated regardless of the operator having no intention to continue the operation Also, even in the case where the drive unit has been braked due to erroneous detection of an object, if it is determined that the detection is apparently erroneous, the operator can apply the present invention to deactivate the braking. Accordingly, the work efficiency of the shovel 100 is improved.

Also, even in the case where the object detection device 70 detects an object, if it is determined that the shovel 100 must be operated for treatment in emergencies, the operator can apply the present invention to deactivate the braking. Therefore, the operator can conduct the treatment in emergencies quickly.

The preferred embodiments of the present invention have been described in detail above. However, the present invention is not limited to the embodiments stated above. Various modifications, substitutions, and the like may be applied to the embodiments described above without departing from the scope of the present invention. Also, the features described separately may be combined unless there is a technical inconsistency.

For example, a hydraulic operation system with a hydraulic pilot circuitry is disclosed in the above-stated embodiments. For example, in a hydraulic pilot circuitry for the left operation lever 26L, the hydraulic oil supplied from the pilot pump 15 to the left operation lever 26L is transmitted to pilot ports of the control valves 176L and 176R at the flow amount depending on the opening degree of a remote control valve that is opened and closed in accordance with the tilt of the left operation lever 26L in the arm opening direction. Alternatively, in a hydraulic pilot circuitry for the right operation lever 26R, the hydraulic oil supplied from the pilot pump 15 to the right operation lever 26R is transmitted to pilot ports of the control valves 175L and 175R at the flow amount depending on the opening degree of a remote control valve that is opened and closed in accordance with the tilt of the right operation lever 26R in the boom up direction.

However, an electric operation system with an electric pilot circuitry may be employed rather than the hydraulic operation system with the hydraulic pilot circuitry. In this case, the lever operation amount of the electric operation lever in the electric operation system may be fed to the controller 30 in the form of electric signals, for example. Also, a solenoid valve is disposed between the pilot pump 15 and pilot ports of the respective control valves. The solenoid valve is configured to operate in accordance with the electric signals from the controller 30. According to this arrangement, if a manual operation is performed by means of the electric operation lever, the controller 30 can move the respective control valves by controlling the solenoid valve with the electric signals corresponding to the lever operation amount to increase or decrease the pilot pressure. Note that each control valve may be composed of a solenoid spool valve. In this case, the solenoid spool valve operates in accordance with the electric signals from the controller 30 corresponding to the lever operation amount of the electric operation lever.

Figure 12:
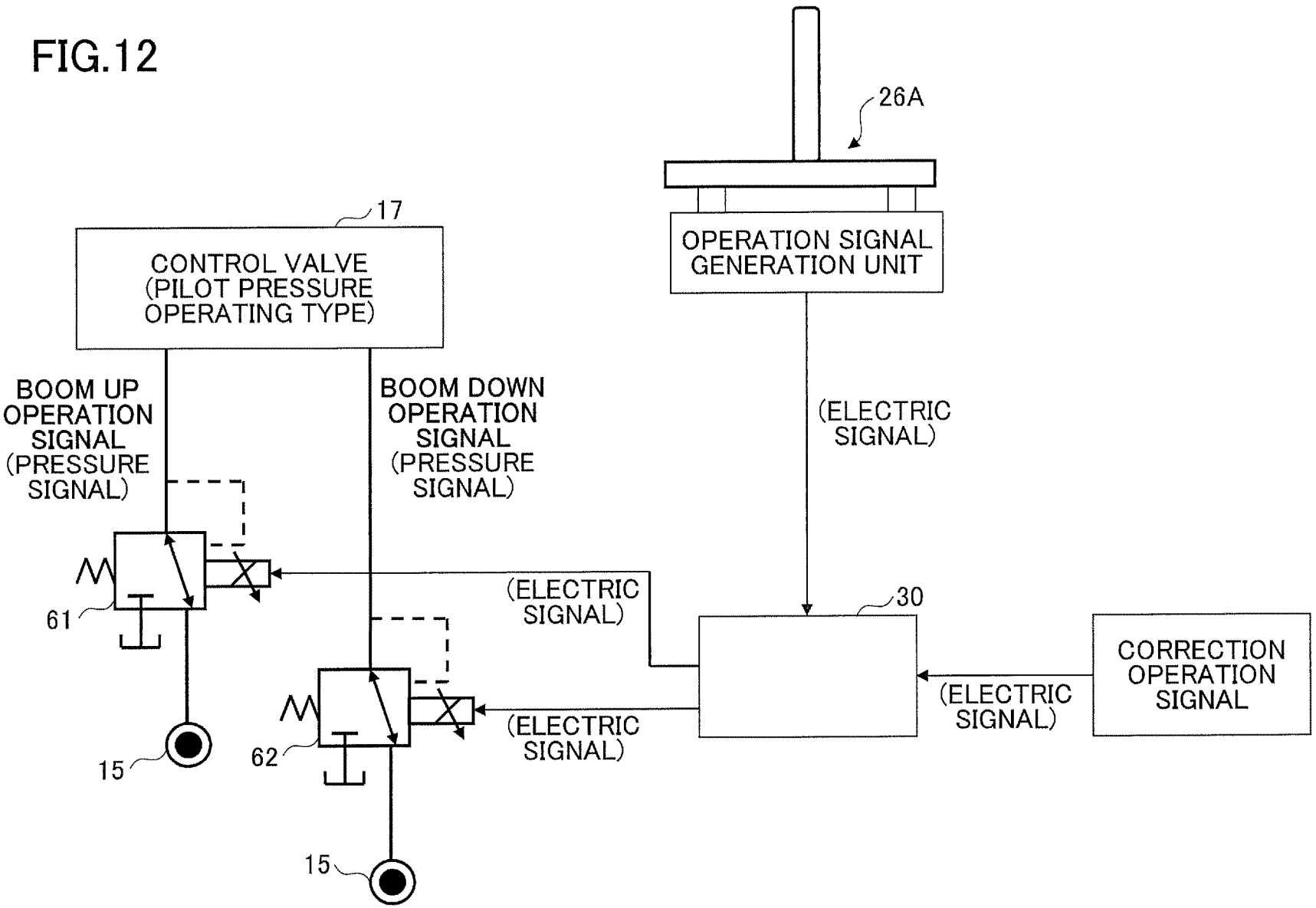
FIG. 12 is a diagram for illustrating an exemplary arrangement of an electric operation system.

FIG. 12 shows an exemplary arrangement of an electric operation system. Specifically, the electric operation system of FIG. 12 is one example of a boom operation system, which mainly composed of a pilot pressure operating type of control valve 17, a boom operation lever 26B as an electric operation lever, a controller 30, a solenoid valve 61 for boom up operation, and a solenoid valve 62 for boom down operation. The electric operation system of FIG. 12 may also be analogously applied to an arm operation system, a bucket operation system, a travelling operation system, a pivot operation system and the like.

As illustrated in FIG. 4, the pilot pressure operating type of control valve 17 includes a control valve 171 for the left travelling hydraulic motor 2ML, a control valve 172 for the right travelling hydraulic motor 2MR, a control valve for the pivot hydraulic motor 2A, a control valve 174 for the bucket cylinder 9, a control valve 175 for the boom cylinder 7, a control valve 176 for the arm cylinder 8, and so on. The solenoid valve 61 is configured to adjust the flow path area of a conduit for coupling the pilot pump 15 to the upside pilot port of the control valve 175. The solenoid valve 62 is configured to adjust the flow path area of a conduit for coupling the pilot pump 15 to the downside pilot port of the control valve 175.

If manual operations are performed, the controller 30 generates a boom up operation signal (electric signal) or a boom down operation signal (electric signal) in response to an operation signal (electric signal) fed from an operation signal generation unit of the boom operation lever 26B. The operation signal output by the operation signal generation unit of the boom operation lever 26B is an electric signal that varies depending on the operation amount and direction of the operation of the boom operation lever 26B.

Specifically, if the boom operation lever 26B is operated in the boom up direction, the controller 30 outputs a boom up operation signal (electric signal) corresponding to the lever operation amount to the solenoid valve 61. The solenoid valve 61 adjusts the flow path area in response to the boom up operation signal (electric signal) to control the pilot pressure applied to the upside pilot port of the control valve 175. Similarly, if the boom operation lever 26B is operated in the boom down direction, the controller 30 outputs a boom down operation signal (electric signal) corresponding to the lever operation amount to the solenoid valve 62. The solenoid valve 62 adjusts the flow path area in response to a boom down operation signal (electric signal) to control the pilot pressure applied to the downside pilot port of the control valve 175.

If autonomous control is performed, for example, the controller 30 generates a boom up operation signal (electric signal) or a boom down operation signal (electric signal) in response to a correction operation signal (electric signal), instead of an operation signal fed from the operation signal generation unit of the boom operation lever 26B. The correction operation signal may be an electric signal generated by the controller 30 or an electric signal generated by an external controller other than the controller 30.

Figure 13:
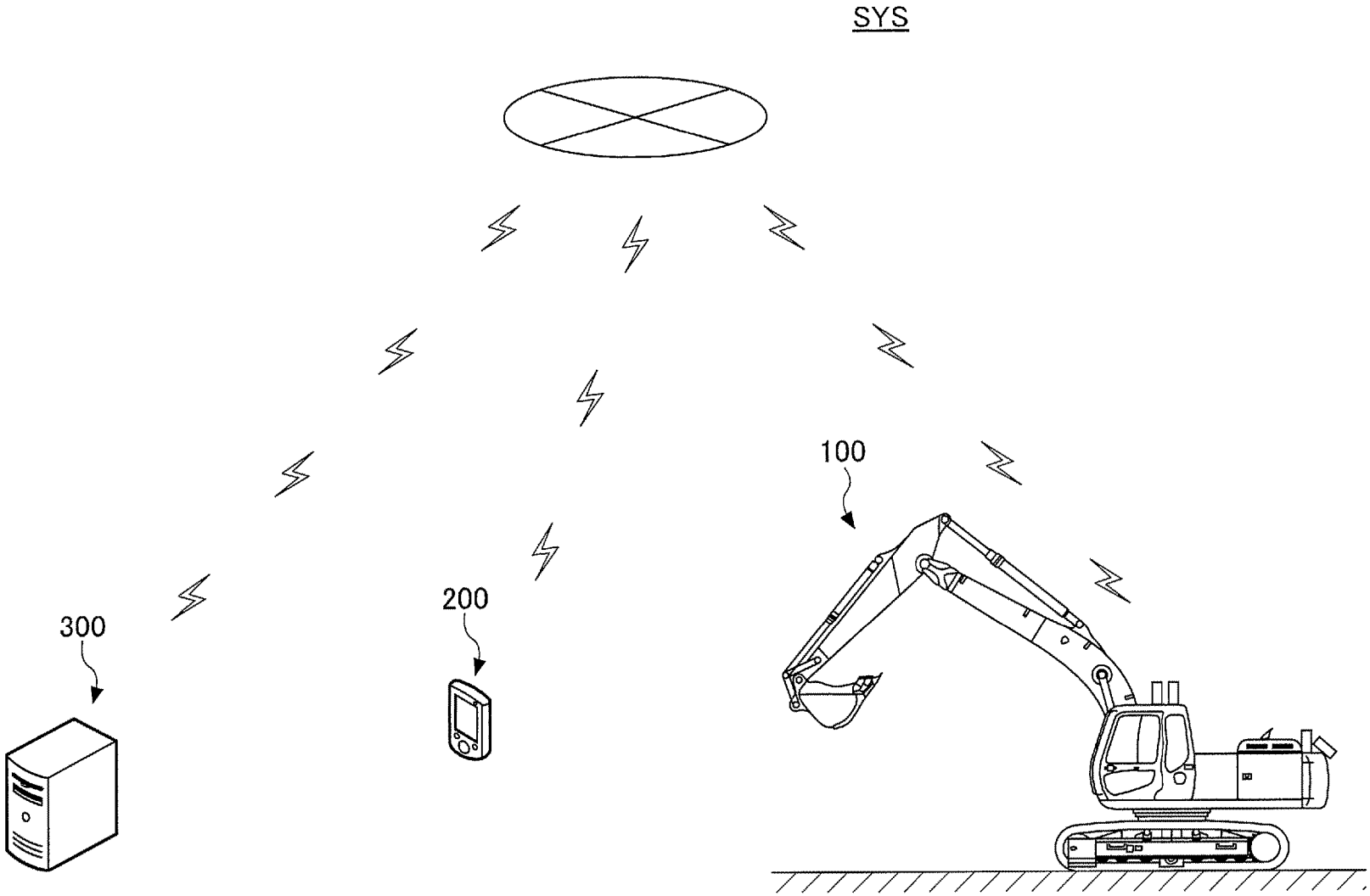
FIG. 13 is a schematic diagram for illustrating one exemplary arrangement of a shovel management system.

Also, information obtained by the shovel 100 may be shared with an administrator and other shovel operators through a shovel management system SYS as shown in FIG. 13. FIG. 13 is a schematic diagram for illustrating an exemplary arrangement of the shovel management system SYS. The management system SYS is a system for managing the shovel 100. In this embodiment, the management system SYS primarily includes a shovel 100, an assistance device 200, and a management device 300. The shovel 100, the assistance device 200, and the management device 300 composing the management system SYS may each be a single unit or multiple units. In the example of FIG. 13, the management system SYS includes the single shovel 100, the single support device 200, and the single management device 300.

The assistance device 200 is typically a portable terminal device, for example, a computer such as a notebook PC, a tablet PC, or a smartphone carried by a worker or others at a construction site. The assistance device 200 may be a computer carried by an operator of the shovel 100. However, the assistance device 200 may be a fixed terminal device.

The management device 300 is typically a fixed terminal device, for example, a server computer installed in a management center or the like outside a construction site. The management device 300 may be a portable computer (for example, a portable terminal device such as a notebook PC, a tablet PC, or a smartphone).

At least one of the assistance device 200 and the management device 300 (hereinafter referred to as the "assistance device 200 and others") may include a monitor and an operation device for remote control. In this case, the operator operates the shovel 100 using a remote control device. The control device for remote control is connected to the controller 30 through a communication network, for example, a radio communication network.

In the shovel management system SYS as described above, the controller 30 of the shovel 100 may transmit information regarding at least one of the time and location at which the drive unit has been braked (a braking command has been output) and the time and location at which the braking of the drive unit has been deactivated (output of the brake command has been stopped) to the assistance device 200 and others. At this time, the controller 30 may transmit a peripheral image, which is an image captured by the capturing device S6, to the assistance device 200 and others. The peripheral image may be a plurality of peripheral images captured during a predetermined period, including at least one of the time point at which the drive unit is braked and the time point at which the braking of the drive unit is deactivated. Additionally, the controller 30 may transmit information regarding at least one of the following data to the assistance device 200 and others: data regarding work contents of the shovel 100 during a predetermined period, including at least one of the time point at which the drive unit is braked and the time point at which the braking of the drive unit is deactivated; data regarding the posture of the shovel 100; data regarding the posture of an excavation attachment and the like.

Alternatively, the controller 30 may transmit at least one of information regarding work contents of the shovel 100, information regarding working environment, and information regarding the movement of the shovel 100 and the like to the assistance device 200 and others in at least one of the time point at which the drive unit is braked and the time point at which the braking of the drive unit is deactivated, and during a period before and after these time points. The information regarding the working environment includes at least one of, for example, information on the slope of the ground and information on the weather. The information regarding the movement of the shovel 100 includes at least one of, for example, the pilot pressure and the hydraulic oil pressure in the hydraulic actuator. This is to enable the administrator using the assistance device 200 to obtain information regarding the work site. Namely, this is because the administrator is enabled to analyze the cause of the braking of the driving unit and the like, and further because the administrator is enabled to improve the working environment of the shovel 100 based on the results of such analysis.

What is claimed is:

1. A shovel, comprising:

a lower travelling body;

an upper pivot body pivotably mounted to the lower travelling body;

a cabin provided to the upper pivot body;

an actuator that drives the lower travelling body or the upper pivot body;

an operation lever mounted in the cabin and operated to move the actuator;

an object detection device provided to the upper pivot body; and a hardware processor that brakes the actuator, wherein the hardware processor automatically brakes the actuator in response to the object detection device detecting an object while an operator is performing an operation with the operation lever, and deactivates the braking in response to determining that the operator has an intention to continue the operation, and the hardware processor determines that the operator has the intention to continue the operation in response to determining that the operator has performed another operation with the operation lever after the braking of the actuator.

2. The shovel as claimed in claim 1, wherein the hardware processor determines that the operator has performed said another operation with the operation lever in response to determining that the operator has operated the operation lever in a predetermined operation direction multiple times.

3. The shovel as claimed in claim 1, wherein the hardware processor determines that the operator has the intention to continue the operation in response to determining that the operator has performed said another operation with the operation lever with a predetermined switch being operated after the braking of the actuator.

4. The shovel as claimed in claim 1, further comprising:

an indoor capturing device that captures an interior of a cabin, wherein the hardware processor determines whether the operator has the intention to continue the operation based on an image captured by the indoor capturing device.

5. The shovel as claimed in claim 1, wherein the hardware processor determines that the operator has performed said another operation with the operation lever in response to determining that the operator has operated the operation lever in a predetermined direction for longer than or equal to a certain time.

6. The shovel as claimed in claim 1, further comprising:

a sound recognition device that recognizes a sound, wherein the hardware processor determines whether the operator has the intention to continue the operation based on the sound recognized by the sound recognition device.

7. The shovel as claimed in claim 1, wherein the hardware processor determines that the operator has the intention to continue the operation in response to determining that the operator has performed said another operation with the operation lever within a period longer than or equal to a predetermined lower limit time and shorter than or equal to a predetermined upper limit time, the predetermined lower limit time and the predetermined upper limit time each being time elapsed from the braking of the actuator.

* * * * *